US011267114B2

(12) United States Patent
Meyer et al.

(10) Patent No.: US 11,267,114 B2
(45) Date of Patent: Mar. 8, 2022

(54) SINGLE-MOTION MAGAZINE RETENTION FOR FASTENING TOOLS

(71) Applicant: BLACK & DECKER INC., New Britain, CT (US)

(72) Inventors: Jeffrey J. Meyer, Baltimore, MD (US); Stuart E. Garber, Towson, MD (US)

(73) Assignee: Black & Decker, Inc., New Britain, CT (US)

( * ) Notice: Subject to any disclaimer, the term of this patent is extended or adjusted under 35 U.S.C. 154(b) by 413 days.

(21) Appl. No.: 15/196,175

(22) Filed: Jun. 29, 2016

(65) Prior Publication Data

US 2018/0001451 A1 Jan. 4, 2018

(51) Int. Cl.
*B25C 1/00* (2006.01)
*B25C 1/06* (2006.01)

(52) U.S. Cl.
CPC ..... *B25C 1/001* (2013.01); *B25C 1/005* (2013.01); *B25C 1/06* (2013.01)

(58) Field of Classification Search
CPC ..... B25C 1/001; B25C 1/005
See application file for complete search history.

(56) References Cited

U.S. PATENT DOCUMENTS 1,526,025 A 2/1925 Street
2,594,605 A 4/1952 Zoppelt
2,745,689 A 5/1956 Balint et al.
2,822,698 A 2/1958 Gross
2,979,725 A * 4/1961 Wandel ..... B25C 1/005 173/169
3,172,124 A 3/1965 Kremiller
3,225,443 A 12/1965 Young
3,480,210 A 11/1969 Perrinjaquet
3,563,438 A 2/1971 Doyle et al.
3,570,739 A * 3/1971 Volkmann ..... B25C 5/16 227/127
3,603,281 A 9/1971 Froelich
3,658,229 A 4/1972 Pomeroy
3,659,768 A * 5/1972 Brunelle ..... B25C 1/082 227/10

(Continued)

FOREIGN PATENT DOCUMENTS

DE 29917830 U1 10/1999
EP 218778 A1 4/1987

(Continued)

OTHER PUBLICATIONS

Extended European Search Report dated Mar. 29, 2018.

(Continued)

*Primary Examiner* — Anna K Kinsaul
*Assistant Examiner* — Daniel Jeremy Leeds
(74) *Attorney, Agent, or Firm* — Rhonda Barton

(57) ABSTRACT

A fastening tool including a magazine securely and releasably retained on the fastening tool by a cam mounted on one of the fastening tool and the magazine. In a single rotary motion, the cam wedges together the housing member of the fastening tool and the housing member of the magazine, while simultaneously rotating cam lobes into respective chambers formed on the fastening tool and the magazine. The cam rotation and magazine retention system is accomplished without tools.

26 Claims, 17 Drawing Sheets

(56) References Cited

U.S. PATENT DOCUMENTS 3,743,159 A * 7/1973 Schneider ..... B25C 1/186 227/10
3,765,588 A 10/1973 Frederickson
3,774,293 A 11/1973 Golsch
3,820,705 A 6/1974 Beals
3,827,822 A 8/1974 Converse
3,890,058 A 6/1975 Self et al.
3,893,610 A 7/1975 Smith
3,979,040 A 9/1976 Denin
4,033,499 A 7/1977 Butler
4,049,181 A 9/1977 Kametaki
4,129,240 A 12/1978 Geist
4,186,862 A 2/1980 Klaus
4,197,974 A 4/1980 Morton et al.
4,230,249 A 10/1980 Nasiatka et al.
4,270,587 A 6/1981 Ludy
4,270,687 A 6/1981 Maurer
4,304,349 A * 12/1981 Novak ..... B25C 1/047 206/338
4,313,552 A 2/1982 Maurer
4,314,782 A 2/1982 Beekenkamp
4,316,513 A 2/1982 Harris
4,389,012 A 6/1983 Grikis et al.
4,403,725 A 9/1983 Lawrence
4,404,894 A 9/1983 Oesterle
4,416,172 A 11/1983 Medinger
4,424,929 A 1/1984 Weis
4,468,159 A 8/1984 Oster
4,485,952 A 12/1984 Weis
4,487,355 A 12/1984 Ginnow et al.
4,519,535 A 5/1985 Crutcher
4,558,811 A 12/1985 Klaus
4,566,621 A * 1/1986 Becht ..... B25C 1/06 227/109
4,597,517 A * 7/1986 Wagdy ..... B25C 1/008 227/120
4,667,747 A 5/1987 Falls et al.
4,765,786 A 8/1988 Krogh
4,807,793 A 2/1989 Ghibely
4,834,342 A 5/1989 Padgett
4,854,393 A 8/1989 Palet
4,863,089 A 9/1989 McCardle et al.
4,912,848 A 4/1990 Bidanset
4,967,623 A 11/1990 Jackson
5,025,968 A 6/1991 Nasiatka
5,074,453 A 12/1991 Tachihara et al.
5,134,812 A 8/1992 Hoffman et al.
5,165,827 A 11/1992 Miller
5,192,012 A 3/1993 Schafer et al.
5,261,588 A 11/1993 Lin
5,297,886 A 3/1994 Jansen et al.
5,368,213 A * 11/1994 Massari, Jr. ..... B25C 1/005 227/120
5,405,071 A 4/1995 Baugus
5,462,127 A 10/1995 Svensson
5,478,002 A 12/1995 Clement et al.
5,484,094 A 1/1996 Gupta
5,495,973 A 3/1996 Ishizawa et al.
5,575,051 A 11/1996 Moore
5,588,577 A * 12/1996 Chen ..... B25C 1/005 227/109
5,647,525 A 7/1997 Ishizawa
5,649,661 A 7/1997 Masuno et al.
5,683,024 A 11/1997 Eminger et al.
5,695,108 A * 12/1997 Lee ..... B25C 5/1644 227/109
5,711,471 A 1/1998 White
5,779,145 A 7/1998 Zelle et al.
5,782,395 A 7/1998 Sauer
5,813,588 A 9/1998 Lin
5,816,468 A 10/1998 Yang
5,831,817 A 11/1998 Chang
5,921,562 A 7/1999 Robison
5,931,364 A 8/1999 Dennis
6,036,072 A * 3/2000 Lee ..... B25C 1/005 227/120
6,053,389 A 4/2000 Chu et al.
6,056,181 A 5/2000 Chuang
6,112,831 A 9/2000 Gustafsson
6,131,787 A 10/2000 Curtis
6,145,723 A 11/2000 Gupta
6,149,046 A 11/2000 Ho et al.
6,161,744 A 12/2000 Mukoyama et al.
6,199,739 B1 3/2001 Mukoyama et al.
6,308,879 B1 10/2001 Wang
6,364,192 B1 4/2002 Lin
6,371,348 B1 * 4/2002 Canlas ..... B25C 1/008 123/46 SC
6,394,332 B2 5/2002 Akiba
6,431,428 B1 * 8/2002 Chen ..... B25C 1/00 227/119
6,557,743 B2 * 5/2003 Schuster ..... B25C 1/005 227/109
6,585,142 B1 7/2003 Chen
6,598,775 B1 7/2003 Chen
6,598,777 B2 7/2003 Osuga et al.
6,641,018 B2 11/2003 Akiba
6,672,497 B2 1/2004 Lin
6,691,907 B1 2/2004 Chang
6,769,591 B2 8/2004 Yamamoto et al.
6,789,718 B2 9/2004 Canlas et al.
6,796,475 B2 9/2004 Adams
6,805,272 B1 10/2004 Sen-Mu et al.
D498,127 S 11/2004 Leasure
6,814,156 B2 11/2004 Dieterle et al.
6,908,021 B1 6/2005 Wang
6,913,180 B2 * 7/2005 Schuster ..... B25C 1/005 227/109
6,918,527 B2 7/2005 Hakozaki et al.
D509,418 S 9/2005 Leasure
6,948,647 B1 9/2005 Niblett et al.
6,966,477 B1 11/2005 Chien-Kuo et al.
6,971,567 B1 12/2005 Cannaliato et al.
6,974,061 B2 12/2005 Adams et al.
6,974,062 B2 12/2005 Akiba
6,978,920 B2 12/2005 Hamada et al.
7,000,294 B2 * 2/2006 Kakuda ..... B25C 1/005 227/120
D520,839 S 5/2006 Miwa
7,055,728 B2 6/2006 Lin
7,070,082 B2 7/2006 Ronconi
7,086,573 B1 8/2006 Wen
7,100,475 B1 9/2006 Rufolo, Jr.
7,134,586 B2 11/2006 McGee et al.
7,138,595 B2 11/2006 Berry et al.
7,140,524 B2 11/2006 Hung et al.
7,143,921 B2 12/2006 Hakozaki et al.
7,165,305 B2 1/2007 Kenney et al.
7,204,403 B2 4/2007 Kenney et al.
7,210,607 B2 5/2007 Niblett et al.
7,225,960 B2 6/2007 Chen
D551,931 S 10/2007 Leasure
7,285,877 B2 10/2007 Gorti et al.
D556,003 S 11/2007 Buck
7,303,103 B2 12/2007 Wang
7,322,506 B2 1/2008 Forster
D562,664 S 2/2008 Buck
7,328,826 B2 2/2008 Shkolnikov
7,331,403 B2 2/2008 Berry et al.
7,410,084 B1 8/2008 Reed
7,413,103 B1 8/2008 Ho et al.
7,451,735 B2 11/2008 Riley et al.
7,469,811 B2 12/2008 Shima et al.
7,470,081 B2 12/2008 Miyahara et al.
7,484,647 B2 2/2009 Yang
7,494,036 B2 2/2009 Shima et al.
7,497,058 B2 3/2009 Martensson
7,503,401 B2 3/2009 Gross et al.
7,506,787 B2 3/2009 Wu et al.
7,513,402 B2 4/2009 Miyashita et al.
7,516,532 B2 4/2009 Wojcicki
7,552,852 B2 6/2009 Haskins et al.
7,556,184 B2 7/2009 Brendel et al.

(56) References Cited

U.S. PATENT DOCUMENTS 7,559,447 B2 7/2009 Chen et al.
7,571,844 B2 8/2009 Bromley et al.
7,575,140 B2 8/2009 Jiang
7,575,141 B1 8/2009 Liang et al.
7,575,142 B2 8/2009 Liang et al.
7,637,408 B2 12/2009 Takahashi et al.
7,654,430 B2 2/2010 Cho et al.
7,686,199 B2 3/2010 Gross et al.
7,690,546 B2 4/2010 Cortez
7,726,536 B2 6/2010 Gross et al.
7,748,588 B2 7/2010 Osuga et al.
7,762,443 B2 7/2010 Tamura et al.
7,788,997 B2 9/2010 Kozak et al.
7,789,169 B2 9/2010 Berry et al.
7,866,522 B2 1/2011 Chen et al.
7,870,987 B1 1/2011 Zhang et al.
7,874,469 B2 1/2011 Liu
7,905,377 B2 3/2011 Krondorfer et al.
7,934,565 B2 5/2011 Krondorfer et al.
7,934,566 B2 5/2011 Hlinka et al.
7,959,049 B2 * 6/2011 Dittrich ..... F41A 17/38 227/107
7,975,893 B2 7/2011 Berry et al.
7,980,439 B2 7/2011 Akiba et al.
7,980,441 B2 * 7/2011 Dittrich ..... B25C 5/16 227/10
7,997,467 B2 8/2011 Hirabayashi et al.
8,011,441 B2 9/2011 Leimbach et al.
8,011,547 B2 9/2011 Leimbach et al.
8,011,549 B2 9/2011 Berry et al.
8,025,197 B2 9/2011 Brendel et al.
8,042,717 B2 10/2011 Lam et al.
RE42,987 E 12/2011 Akiba
8,091,752 B2 1/2012 Jian et al.
8,104,658 B2 1/2012 Yu
8,123,099 B2 2/2012 Kenney et al.
8,136,606 B2 3/2012 Krondorfer et al.
8,167,182 B2 5/2012 Shima et al.
8,230,941 B2 7/2012 Leimbach et al.
8,231,039 B2 7/2012 Buck et al.
8,240,534 B2 8/2012 Hirabayashi
8,256,528 B2 9/2012 Oesterle et al.
8,267,296 B2 9/2012 Leimbach et al.
8,267,297 B2 9/2012 Leimbach et al.
8,286,722 B2 10/2012 Leimbach et al.
8,292,143 B2 10/2012 Lee et al.
8,302,833 B2 11/2012 Gross et al.
8,313,012 B2 11/2012 Shima et al.
8,347,978 B2 1/2013 Forster et al.
8,381,830 B2 2/2013 Puzio et al.
8,387,718 B2 3/2013 Leimbach et al.
8,408,327 B2 4/2013 Forster et al.
8,434,566 B2 5/2013 Forster et al.
8,439,242 B2 5/2013 Tanji et al.
8,505,798 B2 8/2013 Simonelli et al.
8,534,527 B2 9/2013 Brendel et al.
8,602,282 B2 12/2013 Leimbach et al.
8,777,081 B2 7/2014 Chen et al.
8,997,744 B2 4/2015 Ho et al.
9,120,028 B2 9/2015 Wilson
9,126,319 B2 9/2015 Gross et al.
9,346,156 B1 5/2016 Fago
9,346,158 B2 5/2016 Garber et al.
9,399,281 B2 7/2016 Brendel et al.
9,459,075 B1 10/2016 Hatcher
9,577,493 B2 2/2017 Ekstrom et al.
9,643,200 B2 5/2017 Belanger
2001/0038026 A1 11/2001 Dickhaut
2002/0104866 A1 * 8/2002 Miller ..... B25C 1/005 227/8
2002/0104868 A1 * 8/2002 Miller ..... B25C 1/005 227/130
2002/0117532 A1 * 8/2002 Miller ..... B25C 1/005 227/120
2002/0174807 A1 11/2002 Mason
2002/0185514 A1 12/2002 Adams et al.
2003/0038786 A1 2/2003 Nguyen et al.
2003/0146262 A1 8/2003 Hwang et al.
2003/0230622 A1 * 12/2003 Rotharmel ..... B25C 1/184 227/120
2004/0169057 A1 * 9/2004 Ronconi ..... B25C 1/005 227/109
2004/0222266 A1 11/2004 Kakuda et al.
2005/0166713 A1 8/2005 Lloyd
2005/0217416 A1 10/2005 Berry et al.
2005/0220445 A1 10/2005 Baskar et al.
2005/0242152 A1 * 11/2005 Ronconi ..... B25C 5/06 227/120
2006/0102685 A1 5/2006 Phillips et al.
2006/0231582 A1 10/2006 Hong et al.
2006/0248998 A1 11/2006 Duginske
2006/0272269 A1 12/2006 Bannister
2006/0273131 A1 * 12/2006 Chen ..... B25C 1/005 227/120
2007/0045345 A1 3/2007 Monfeli et al.
2007/0090148 A1 4/2007 Cho et al.
2007/0102471 A1 5/2007 Gross et al.
2007/0261868 A1 11/2007 Gross
2008/0099525 A1 5/2008 Brendel et al.
2008/0135596 A1 6/2008 Wu et al.
2008/0223894 A1 9/2008 Cruise et al.
2008/0283568 A1 * 11/2008 Nayrac ..... B25C 1/08 227/120
2008/0290128 A1 11/2008 Buetow
2008/0296340 A1 12/2008 Wang
2009/0050668 A1 2/2009 Jian
2009/0084824 A1 4/2009 Jiang
2009/0108046 A1 4/2009 Huang
2009/0120281 A1 5/2009 Yang
2009/0145520 A1 6/2009 Opsitos, Jr. et al.
2009/0152323 A1 6/2009 Lin
2009/0266867 A1 10/2009 Mina et al.
2010/0057014 A1 3/2010 Cane
2010/0116863 A1 5/2010 Suda
2010/0301091 A1 12/2010 Liang et al.
2010/0308098 A1 12/2010 Francis et al.
2011/0057014 A1 3/2011 Yang et al.
2011/0114692 A1 5/2011 Liang et al.
2011/0132959 A1 6/2011 Hlinka et al.
2011/0198381 A1 8/2011 McCardle et al.
2011/0215131 A1 * 9/2011 Liang ..... B25C 1/00 227/120
2011/0278342 A1 * 11/2011 Kuo ..... B25C 1/001 227/120
2011/0315414 A1 12/2011 Kuntner et al.
2011/0315840 A1 * 12/2011 Connolly ..... F16M 11/041 248/220.31
2012/0074194 A1 3/2012 Miller et al.
2012/0187177 A1 7/2012 Myburgh et al.
2013/0029548 A1 1/2013 Stenzel et al.
2013/0153254 A1 6/2013 Liang et al.
2013/0227869 A1 * 9/2013 Thordsen ..... F41C 27/00 42/6
2013/0240299 A1 9/2013 Jagdale et al.
2013/0306699 A1 11/2013 Baskar et al.
2013/0320059 A1 12/2013 Gregory et al.
2013/0320060 A1 12/2013 Gregory et al.
2013/0320063 A1 12/2013 Gregory et al.
2013/0320064 A1 12/2013 Gregory et al.
2013/0320065 A1 12/2013 Gregory et al.
2013/0320066 A1 12/2013 Gregory et al.
2013/0320067 A1 12/2013 Gregory et al.
2013/0320068 A1 12/2013 Gregory et al.
2014/0069671 A1 3/2014 Leimbach et al.
2014/0097223 A1 4/2014 Baron et al.
2014/0158739 A1 6/2014 Grazioli et al.
2014/0325886 A1 * 11/2014 Mather ..... F41A 17/38 42/6
2014/0361066 A1 12/2014 Liu et al.
2014/0373329 A1 * 12/2014 Volfson ..... F16M 13/02 29/428
2015/0096776 A1 4/2015 Garber

(56) References Cited

U.S. PATENT DOCUMENTS

| | | | |
|---|---|---|---|
| 2015/0122867 | A1 | 5/2015 | Segura |
| 2015/0352702 | A1 | 12/2015 | Chien |
| 2016/0129573 | A1 | 5/2016 | Anstett et al. |
| 2017/0066116 | A1 | 3/2017 | Garber et al. |
| 2017/0232600 | A1 | 8/2017 | King, Jr. |
| 2018/0001454 | A1 | 1/2018 | Jaskot et al. |
| 2018/0001456 | A1 | 1/2018 | Garber |
| 2018/0015600 | A1 | 1/2018 | Akiba |
| 2018/0281840 | A1 | 10/2018 | Yoon et al. |
| 2018/0333888 | A1 | 11/2018 | Bauer et al. |
| 2019/0091844 | A1 | 3/2019 | Akiba |
| 2019/0299380 | A1 | 10/2019 | Meyer et al. |

FOREIGN PATENT DOCUMENTS

| | | | |
|---|---|---|---|
| EP | 931625 | A2 | 7/1999 |
| EP | 1206337 | A2 | 5/2002 |
| EP | 1207017 | A2 | 5/2002 |
| EP | 1795305 | A1 | 6/2007 |
| EP | 1798003 | A1 | 6/2007 |
| EP | 1864759 | A1 | 12/2007 |
| EP | 1884322 | A1 | 2/2008 |
| EP | 2105258 | A2 | 9/2009 |
| EP | 2105259 | A2 | 9/2009 |
| EP | 2301718 | A2 | 3/2011 |
| EP | 2065137 | B1 | 11/2011 |
| EP | 2441552 | A2 | 4/2012 |
| EP | 2687334 | B1 | 6/2016 |
| EP | 2711135 | B1 | 7/2016 |
| GB | 602455 | A | 5/1948 |
| JP | 5499276 | A | 8/1979 |
| JP | H06246649 | A | 9/1994 |
| JP | 2000354981 | A | 12/2000 |
| JP | 2002210676 | A | 7/2002 |
| WO | 2009/046076 | A1 | 4/2009 |
| WO | 2015164032 | A1 | 10/2015 |
| WO | PCT/US2017/039723 | A1 | 9/2017 |

OTHER PUBLICATIONS

Hilti DX460—at least as early as Mar. 17, 2016.
Hilti DX351—at least as early as Mar. 17, 2016.
Ramset XT540—at least as early as Mar. 17, 2016.
Hilti GX120—at least as early as Mar. 17, 2016.
Simpson GCN-MEPMAG—at least as early as Mar. 17, 2016.
Ramset Trackfast—at least as early as Mar. 17, 2016.
T3 Ramset—at least as early as Mar. 17, 2016.
Hilti GX2—at least as early as Mar. 17, 2016.
International Search Report and Written Opinion dated Nov. 2, 2017 in corresponding International Patent Application No. PCT/US2017/039988.
Office Action in corresponding European Patent Application No. 17737706.6 dated Feb. 13, 2020.
International Search Report and Written Opinion dated Oct. 12, 2017 in corresponding International Patent Application No. PCT/US2017/039981.
Extended European Search Report dated Mar. 28, 2018 in corresponding U.S. Appl. No. 15/195,057.
Office Action in corresponding European Patent Application No. 17737194.5 dated Feb. 13, 2020.
Extended European Search Report dated Nov. 20, 2017 in corresponding U.S. Appl. No. 15/629,871.
Copenheaver, Blaine R.—International Search Report and Written Opinion re: related application No. PCT/US2017/039723—dated Sep. 6, 2017—7 pages.
Extended European Search Report dated Jan. 28, 2020 in corresponding U.S. Appl. No. 15/637,720.
Extended European Search Report dated Dec. 3, 2018 in corresponding U.S. Appl. No. 15/899,530.
Extended European Search Report dated Jan. 4, 2018 in corresponding U.S. Appl. No. 15/195,095.

* cited by examiner

| FORCE | ROTATION |
|---|---|
| 0 | 0 |
| 2 | 5 |
| 0 | 10 |
| 0 | 15 |
| 0 | 20 |
| 0 | 25 |
| 0 | 30 |
| 0 | 35 |
| 0 | 40 |
| 0 | 45 |
| 1 | 50 |
| 2 | 55 |
| 3 | 60 |
| 4 | 65 |
| 5 | 70 |
| -2 | 75 |
| -2 | 80 |
| -2 | 85 |
| -2 | 90 |

SINGLE-MOTION MAGAZINE RETENTION FOR FASTENING TOOLS

BACKGROUND OF THE INVENTION

Field of the Invention

The present invention relates to fastening tools, and more particularly to fastening tools with fastener magazines.

Description of the Related Art

Fastening tools, such as concrete nailers, staplers, and other nailers, are normally provided with fastener magazines. Although the magazines are useful for supplying fasteners to be driven into a work surface so that the operator does not have to reload the fastening tool after every shot, fastener magazines present their own set of problems. One of the greatest drawbacks is that fasteners frequently jam in the magazine and fastening tool mechanisms, as they exit the magazine into position along the drive axis of the fastening tool. Then it becomes necessary for the operator to stop work and clear the fastener jam. If, as is frequently the case, the jam is not readily accessible with the magazine attached to the fastening tool, the operator must at least partially remove the magazine from the fastening tool. Ideally, the magazine can be completely removed from the fastening tool to expose more of the drive track for clearing the jam, or to load more fasteners.

However, providing a fastening tool with a totally-removable magazine presents another set of problems. A typical job site demands that any system for retaining the magazine on the fastening tool be robust. This means, for example, that the magazine will not separate from or become misaligned with the fastening tool during the hard use typically experienced by a fastening tool in that environment. In addition to the typical shocks that a fastening tool encounters during the course of the day when being thrust against unyielding work surfaces, fastening tools are frequently dropped; and at the end of the day, they are often thrown into the back of a pickup truck. So the core issue is, how do you design a magazine retention system in which the magazine is easily removable, but that consistently survives the rigors of the job site? It is no wonder that many fastening tool manufacturers have opted to produce tools either with non-removable magazines, or tools where only part of the magazine is removable to clear jams or to load fasteners into the magazine.

To date, conventional attempts to solve the problem have been unsatisfactory. On the one hand, some manufacturers have opted to use simple hook-and-latch systems in an effort to keep costs down. However many of these types of systems fail to maintain the magazine in alignment with the fastening tool drive track, thereby creating a jam-plagued tool, and others simply do not survive long on the job site. On the other hand, in attempting to make magazine retention systems more robust, several manufacturers have made their systems unduly complicated and expensive, such as by requiring that the operator use tools and/or manipulate the latch mechanisms along two or more axes. For example, one conventional system requires that the fastening tool operator use two simultaneous but different motions, namely moving a lever in one direction while simultaneously pushing a button in another direction to release the magazine from the fastening tool. Another system uses an expensive assembly of multiple spring-biased components to latch and unlatch the magazine from the fastening tool. Furthermore, conventional fastening tools with magazines, particularly concrete nailers, do not provide full access to the fastening tool drive track to enable jams involving nails as long as 2½ inches to be easily cleared.

In essence, the state of the art has yielded just two types of solutions: cheap, but not robust; or much more expensive, complicated and more difficult to use. What is needed is a tool-free, low-cost system that requires only a single motion to attach a magazine to, or release it from, a fastening tool, but that provides consistently robust magazine retention even under the most challenging of job site conditions. What is also needed is a magazine that will cooperate with the fastening tool drive track if a nail, including a nail at least as long as 2½ inches, is ever jammed, to provide ready access to the drive track to clear the jam.

SUMMARY OF THE INVENTION

Accordingly, one embodiment of the fastening tool of the present invention provides an elegant solution to all of these problems. In essence, the fastening tool operator need only rotate a one-piece wedge or cam in a single motion against one of a fastening tool housing member and a magazine housing member, thereby sandwiching the wedge and housing members together to releasably retain the magazine on the fastening tool. If desired, that single motion also can simultaneously move one or more lobes of the cam into one or more chambers defined by one of the fastening tool and magazine housings, which thus provides a secondary retention system that is useful, for example, if the fastening tool is dropped. A biasing agent cooperates with the cam to create an over-center latch that releasably retains the cam in the latched position.

To remove the magazine, the fastening tool operator need only rotate a cam lever in the opposite direction to rotate the cam and disengage the over-center latch. This rotation simultaneously releases the wedge and moves the cam lobe(s) out of the chamber(s). The magazine can now be removed from the fastening tool. The magazine retention system of the present invention thus provides a single-motion, tool-free method for quickly and reliably disconnecting a magazine from, and reattaching a magazine to, the fastening tool. Furthermore, the magazine includes a drive interface that cooperates with a drive track of the fastening tool to guide the nails, including those at least as long as 2½ inches, along the drive axis. When the magazine is removed to clear a jam, a full 2½ inches of the concrete nailer drive track is exposed, thereby giving an operator sufficient access to clear the jam.

In addition to being simple, easy to use and robust, the magazine retention system of the present invention is inexpensive to implement. One major reason is because the fastening tool and magazine housings themselves not only provide two of the elements of the wedge sandwich, but also define the chambers for retaining the cam lobes. Inasmuch as the housing members are formed during the same molding operations as are the rest of the respective fastening tool and magazine housings, the housing members are provided at little or no additional cost. Another major reason is that only three additional parts need be provided to complete the magazine retention system of the present invention: a cam, a pressure member and a spring, which three parts cooperate to form the over-center latch system.

Another embodiment of a magazine retention system of the present invention also provides a simplified and even less expensive, yet robust, solution for releasably connecting a fastener magazine to a fastening tool. In this embodiment, one of the fastening tool and fastener magazine housing members includes a floating nut operatively associated with a bolt defining an axis. The other of the fastening tool and fastener magazine housing members defines a bolt receptacle operatively associated with the bolt and being axially aligned with the bolt axis. The fastener magazine is first attached to the fastening tool; the bolt is then threaded through the floating nut and is tightened against the bolt receptacle, thereby releasably retaining the magazine on the fastening tool. One of the advantages of this embodiment is that the bolt receptacle may be configured to define a conical surface axially aligned with the bolt and the floating nut, so that the bolt receptacle conical surface and the bolt cooperate to compensate for variations in tolerances as the bolt is tightened through the nut and against the receptacle.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the present invention, and such exemplifications are not to be construed as limiting the scope of the present invention in any manner.

DETAILED DESCRIPTION OF THE INVENTION

Figure 1:
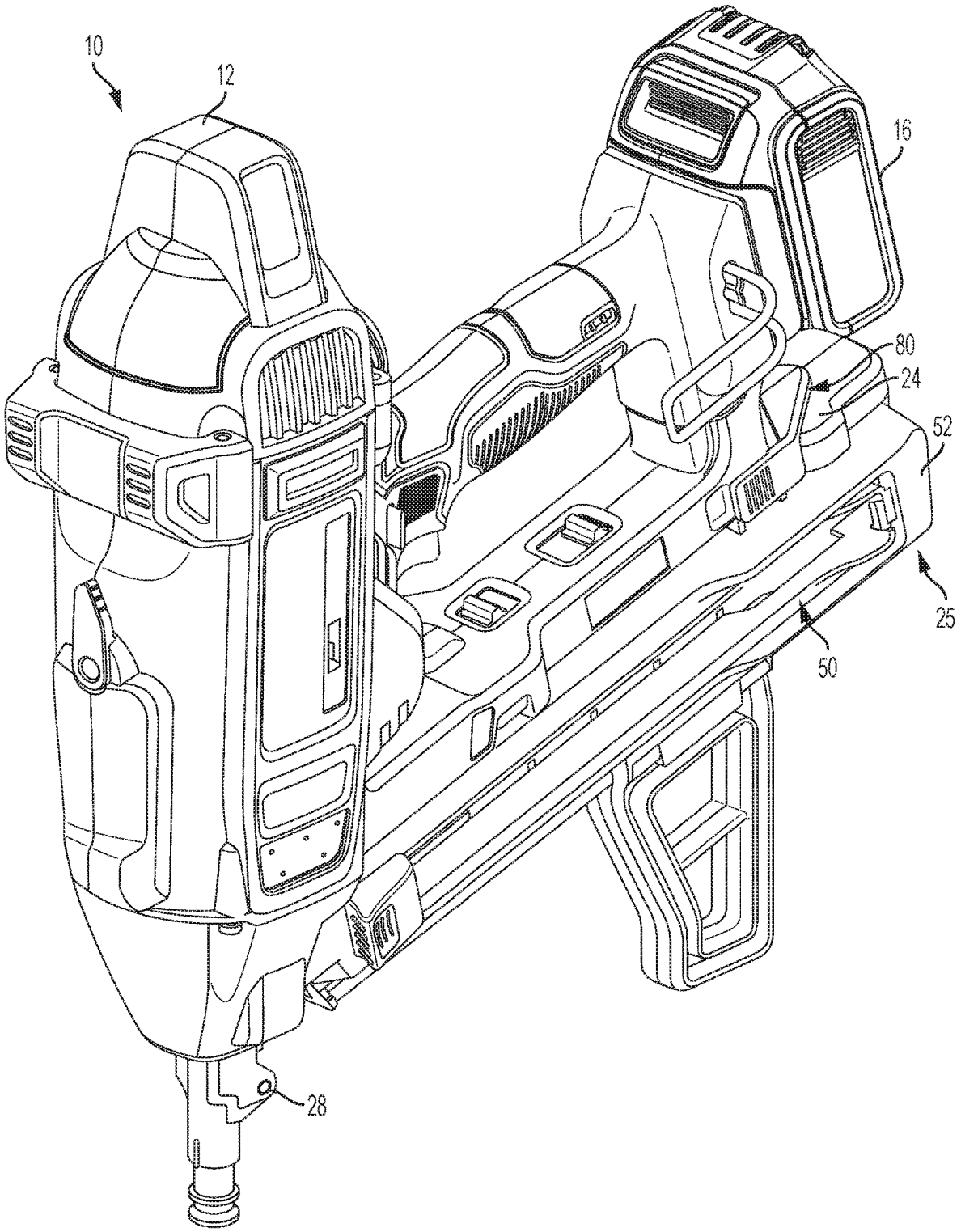
FIG. 1 is a perspective view of one embodiment of a fastening tool and magazine of the present invention.
Figure 2:
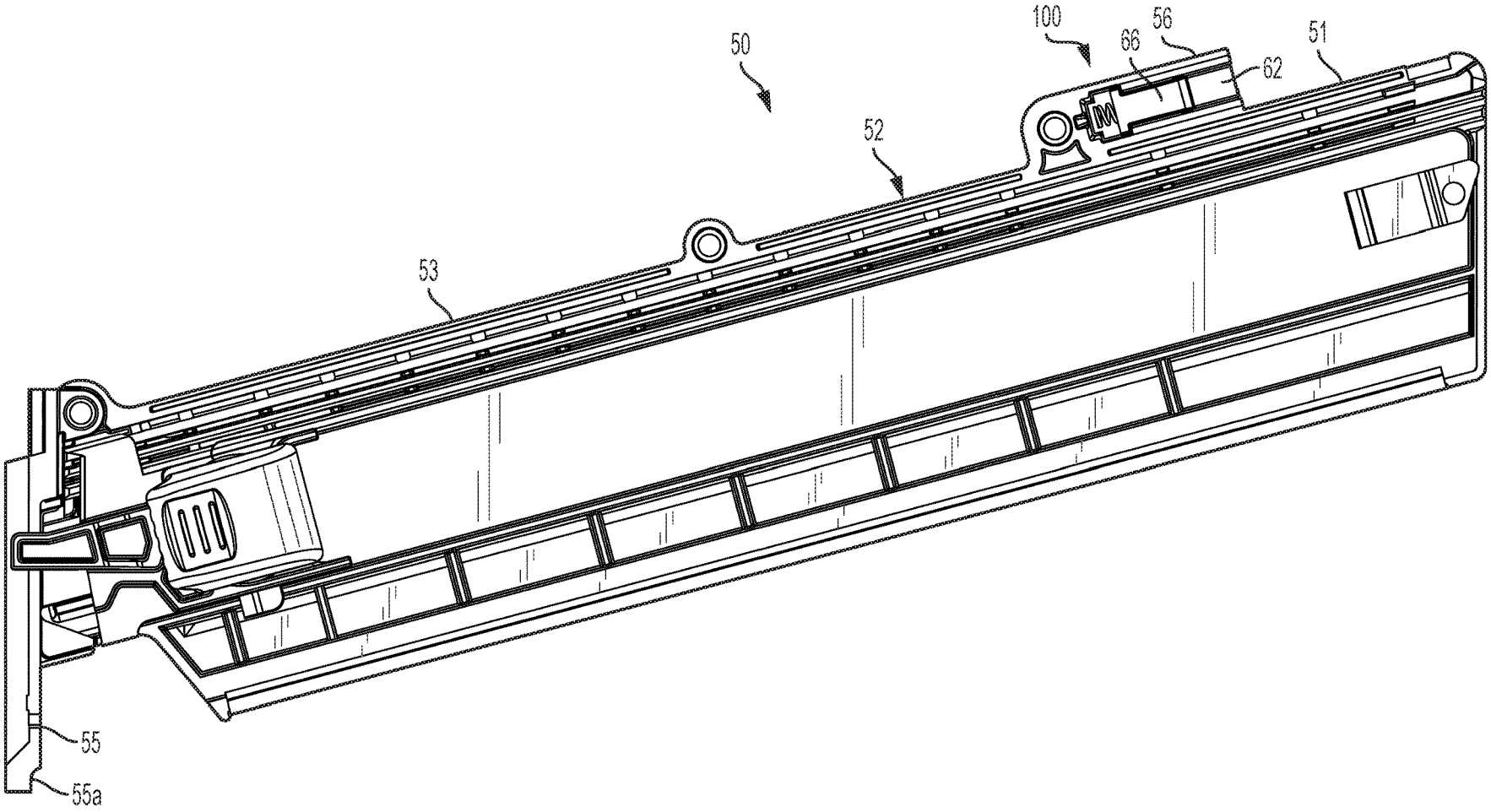
FIG. 2 is an enlarged elevational detail view of half of the magazine of FIG. 1, the other half being omitted for clarity.
Figure 4A:
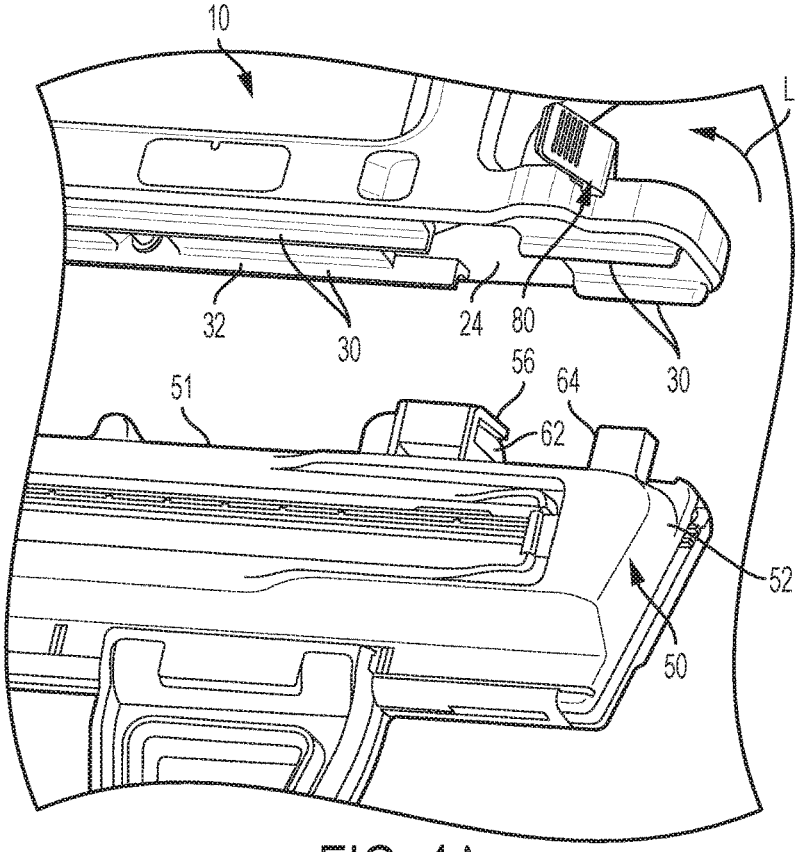
FIGS. 4A and 4B are enlarged partial elevational detail views of the magazine and fastening tool of FIG. 1 spaced apart and illustrating the position of a cam in the unlatched and latched positions, respectively.
Figure 4B:
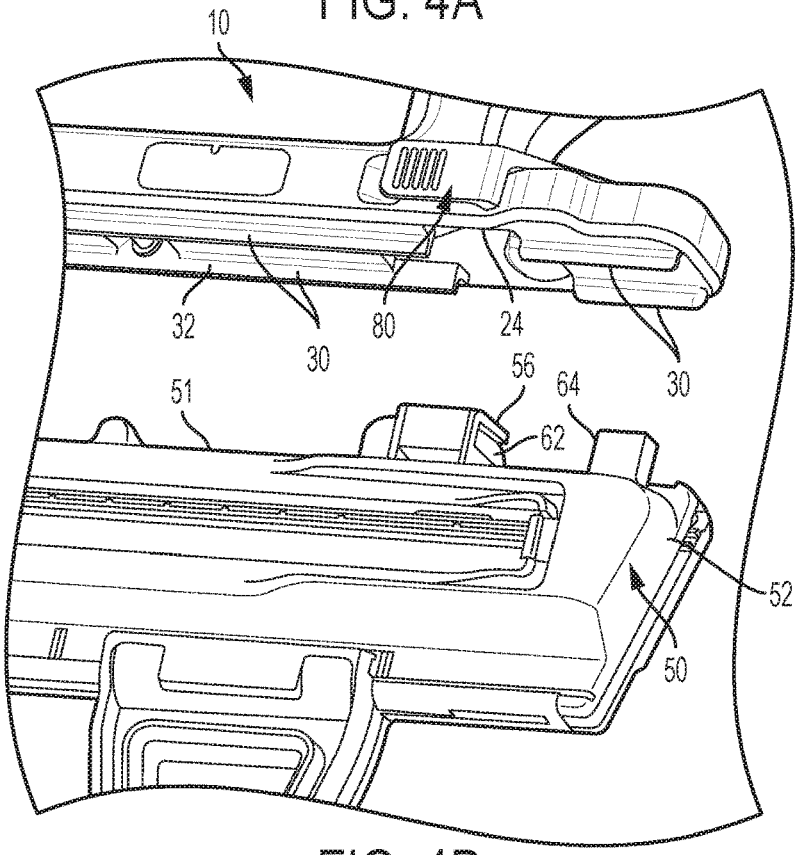
Figure 5A:
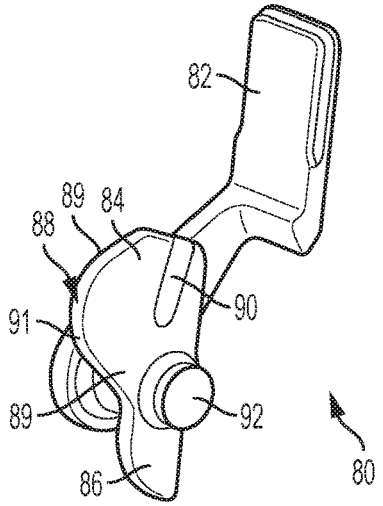
FIG. 5A is a perspective detail view, taken from the rear, of a cam used in the magazine retention system of the fastening tool of FIG. 1.
Figure 5B:
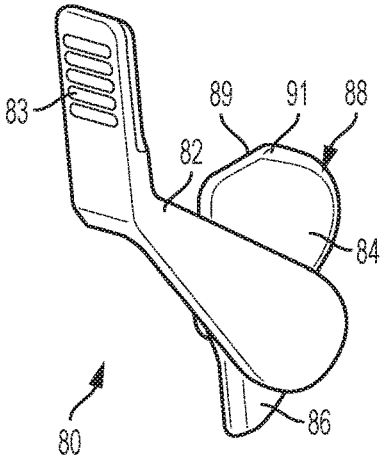
FIG. 5B is a perspective detail view, taken from the front, of the cam of FIG. 5A.
Figure 5C:
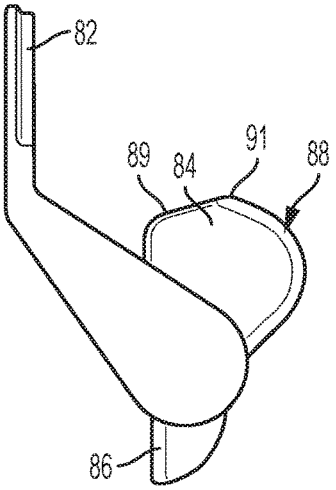
FIG. 5C is a left side elevational view of the cam of FIG. 5A.
Figure 5D:
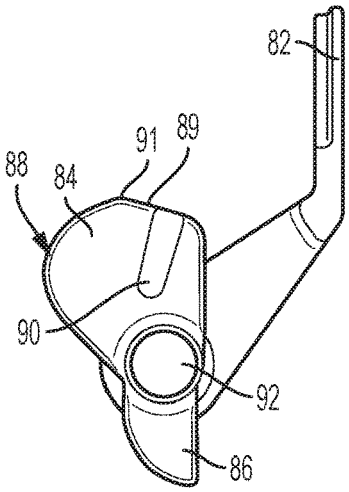
FIG. 5D is a right side elevational view of the cam of FIG. 5A.
Figure 5E:
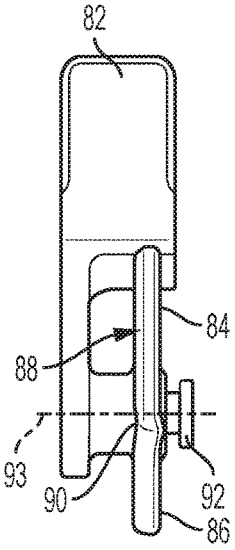
FIG. 5E is a front elevational view of the cam of FIG. 5A.
Figure 5F:
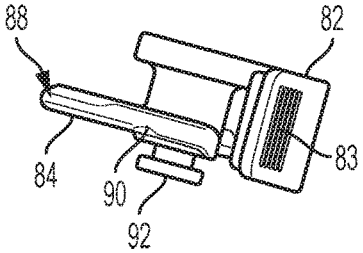
FIG. 5F is a top plan view of the cam of FIG. 5A.
Figure 9A:
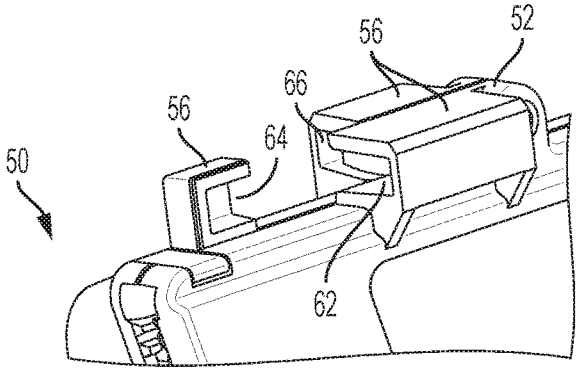
FIG. 9A is a partial perspective detail view of the chambers defined by housing members of the magazine of FIG. 1.
Figure 9B:
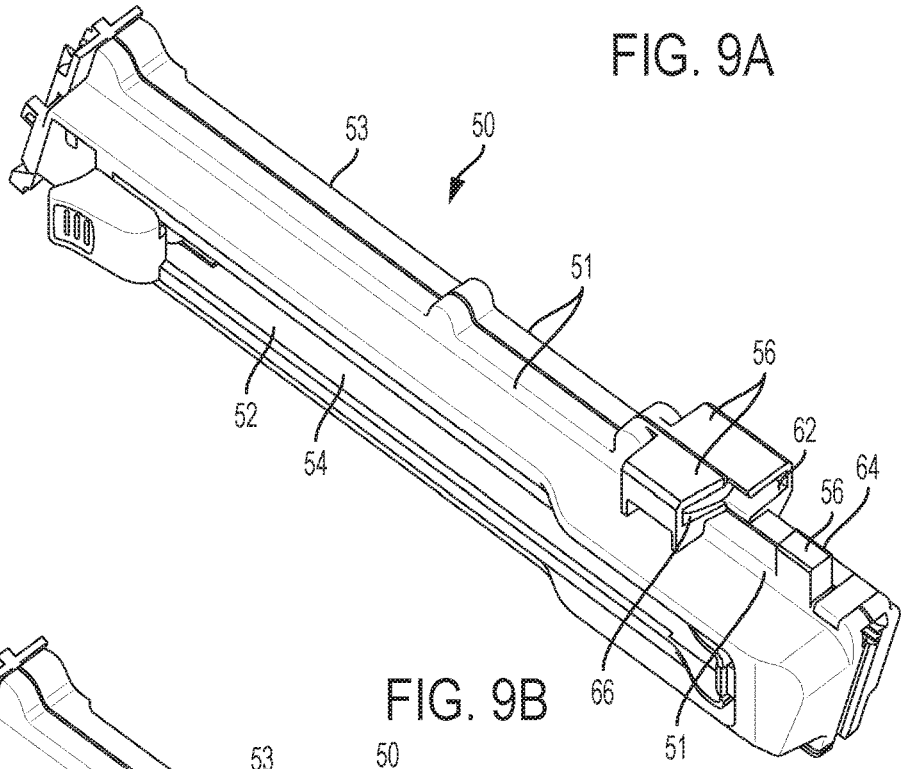
FIG. 9B is a perspective detail view, taken from above, of the magazine of FIG. 1.
Figure 9C:
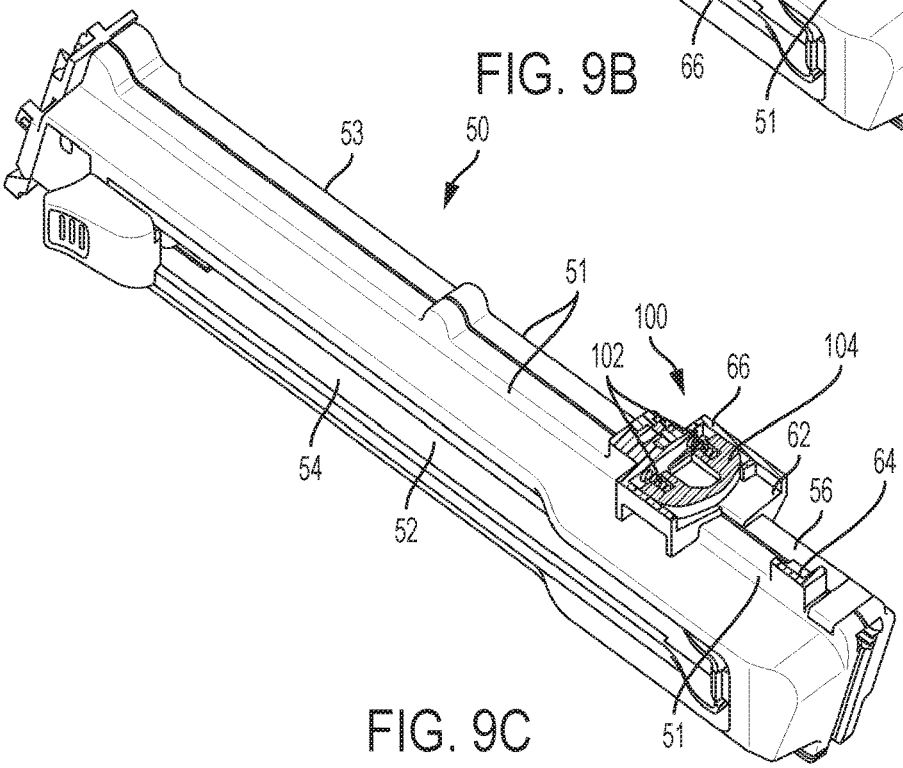
FIG. 9C is a perspective detail view of the magazine of FIG. 9B, with a portion cut away.
Figure 10:
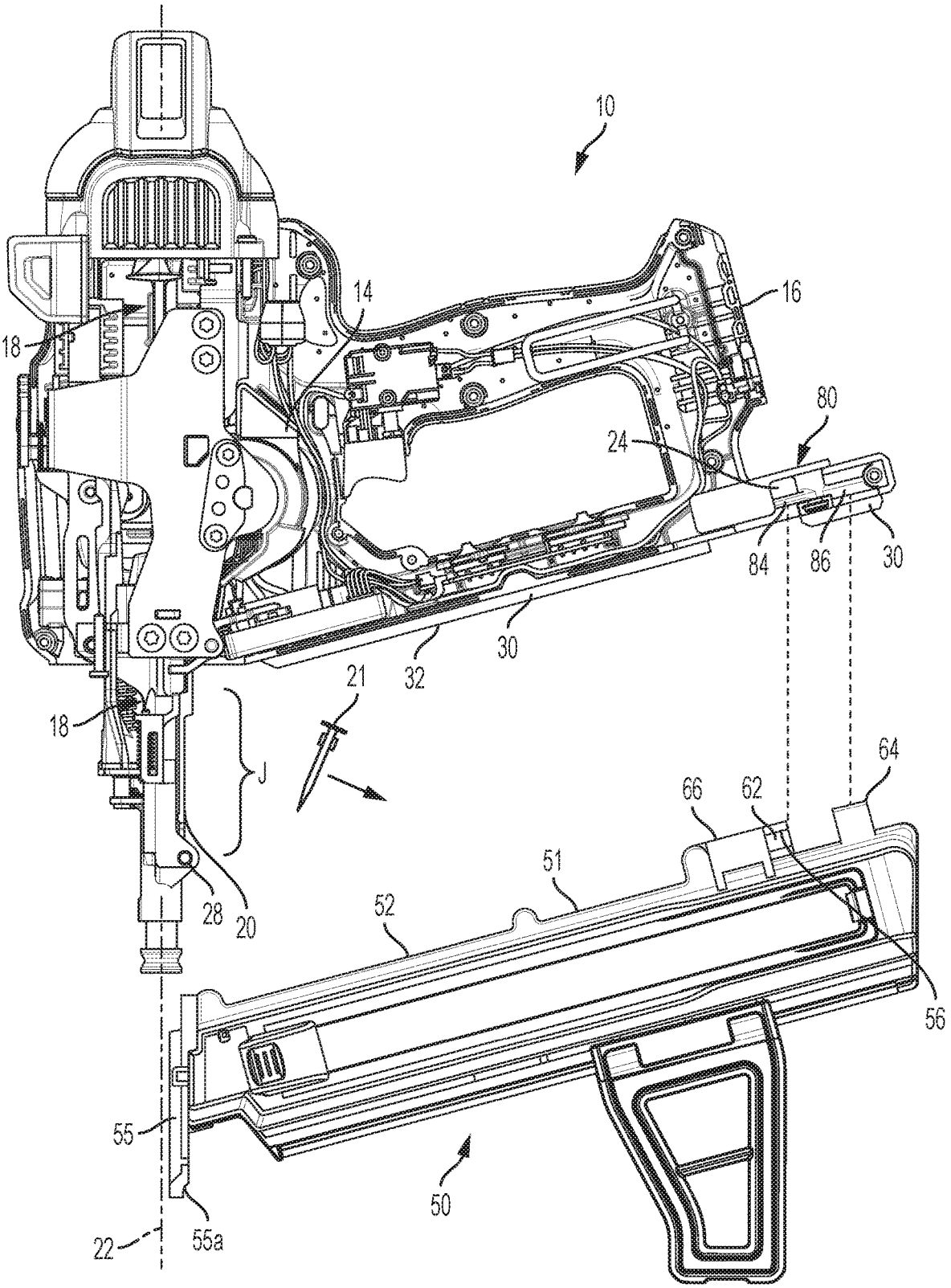
FIG. 10 is an exploded elevational view of the fastening tool (with one housing half removed) and magazine of FIG. 1.

Referring now to the drawings and particularly to FIGS. 1, 9C and 10, a fastening tool 10 in accordance with an embodiment of the present invention includes a housing 12, a motor 14 disposed in the housing, a battery pack 16 for providing power to the motor, and a drive system 18 including a drive track 20. The motor 14 and drive system 18 are configured for driving a fastener, such as a 2½ inch nail 21, along a drive axis 22. The housing 12 includes a plurality of fastening tool housing members 24 that, as described below, play significant roles in the operation of a magazine retention system 25 of the present invention. The main elements of the magazine retention system 25 accordingly include the fastening tool housing 12 and the fastening tool housing members 24, plus a magazine 50, a plurality of magazine housing members 56, a cam 80 and a biasing agent 100 (FIG. 9C). Referring again to FIGS. 1 and 10, the fastening tool 10 further includes a pivot member 28 disposed proximate the lower end of the drive track 20. Now referring also to FIGS. 4A and 4B, the fastening tool 10 additionally defines alignment surfaces 30 disposed on a bottom portion 32 of the housing 12, that cooperate with corresponding surfaces on the magazine 50, as described below.

At this point, it should be noted that although the embodiments of the present invention depicted in the Drawings are shown as concrete nailers, it will be appreciated that the present invention can be incorporated in any fastening tool, including, without limitation, staplers and other nailers. Furthermore, although the embodiments of the magazine retention system 25 are shown being used in connection with a fastening tool using an electric-powered drive system, it will be appreciated that the magazine retention system of the present invention is also capable of being used in connection with fastening tools using pneumatic, hydraulic, and gas/explosive drive systems, among others.

Moving now to the magazine 50, one embodiment is shown, for example, in FIGS. 1, 2, 4A and 4B, 9B and 9C, and 10. The magazine 50 includes a magazine housing 52, that further includes right and left halves 53 and 54, respectively (FIGS. 2, 9B and 9C), and magazine alignment surfaces 51, that cooperate with respective fastening tool alignment surfaces 30 to maintain the magazine in alignment with the fastening tool 10 as the magazine is being attached to the fastening tool, and thereafter. As shown particularly in FIG. 10, the magazine 50 also includes a drive interface 55 that in turn defines a pivot member-engaging portion 55*a*. The magazine 50 supplies a plurality of fasteners such as nails 21 to the fastening tool drive track 20 via the magazine drive interface 55. Magazine housing 52 also includes the plurality of magazine housing members 56, that cooperate with respective fastening tool housing members 24 in the magazine retention It will be useful now to describe how the fastening tool 10 and the magazine 50 cooperate to provide ready access to a nail ranging in length up to at least 2½ inches. Referring to FIG. 10, when connected together, the magazine interface 55 cooperates with the fastening tool drive track 20 to maintain a fastener, such as the 2½ inch nail 21, aligned with the drive axis 22. By incorporating part of the nail-guiding system into the magazine drive interface 55, and by making the drive track-magazine interface combination at least as long as 2½ inches, at least 2½ inches of the drive track 20 will be exposed when magazine 50 is removed from fastening tool 10. Consequently, the cooperation of these elements provides plenty of room to clear the jams from the region J when the magazine 50 is detached from the fastening tool housing 12, yet it accurately aligns fasteners 21 along the drive axis 22 when the magazine and fastening tool housing are connected together.

Figure 3A:
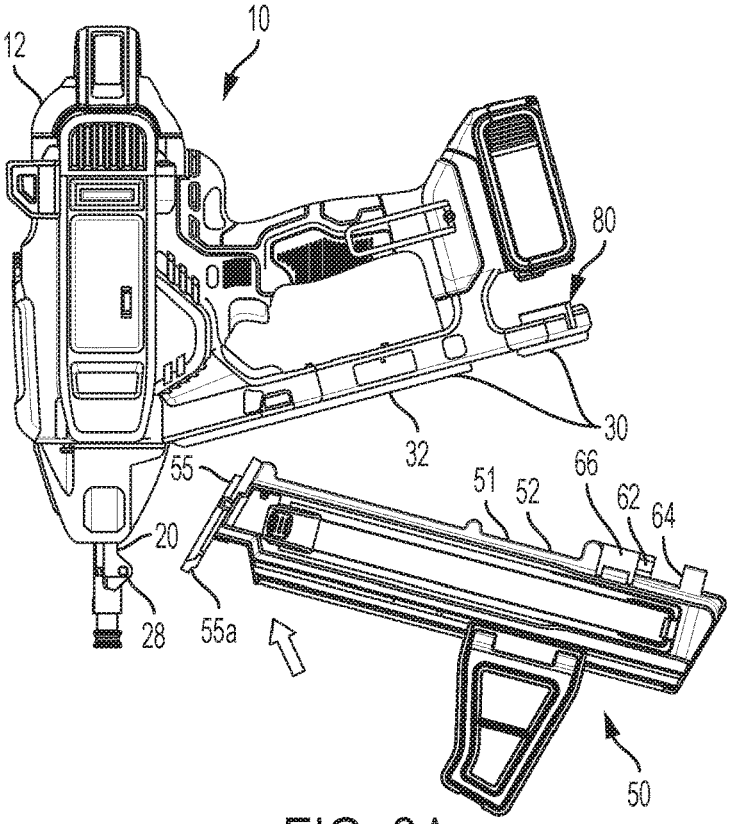
FIGS. 3A and 3B are elevational detail views of the magazine and fastening tool of FIG. 1 as they are being connected together.
Figure 3B:
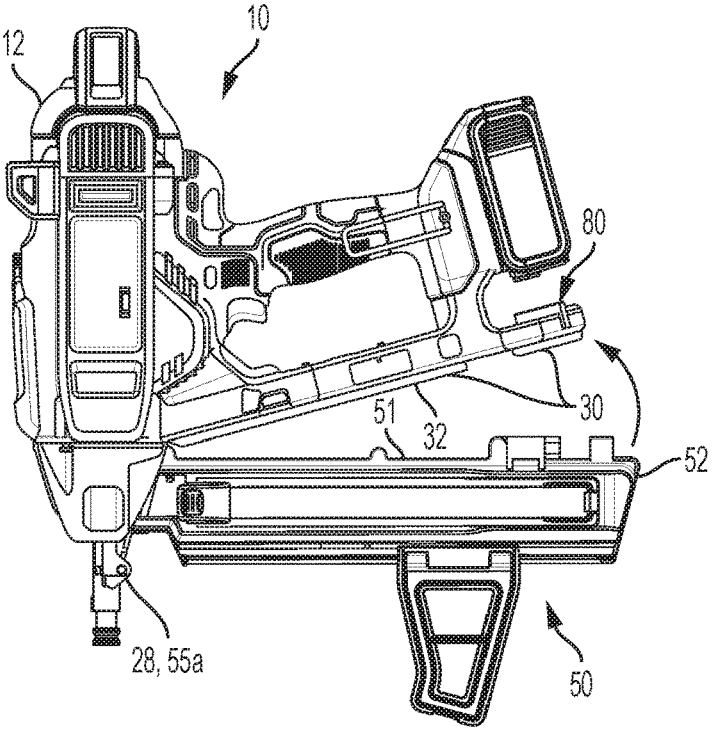
Figure 7:
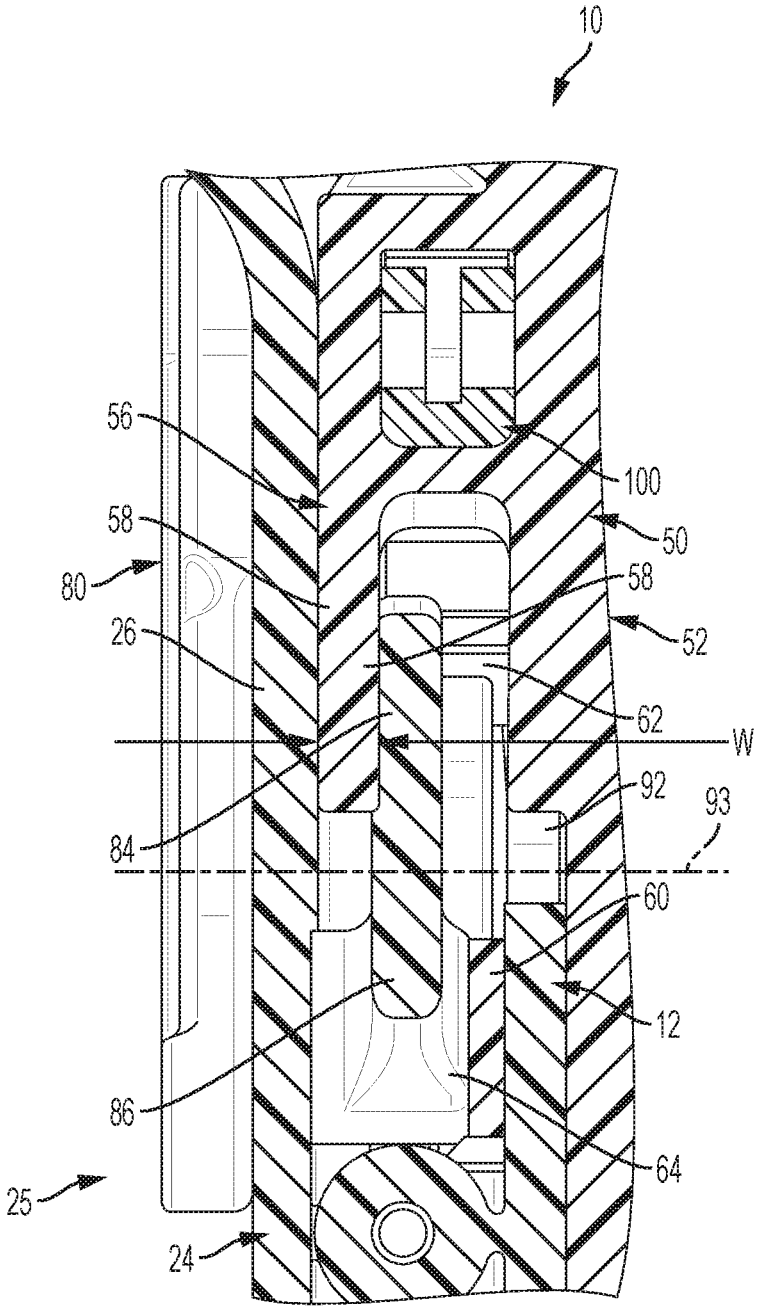
FIG. 7 is a partial sectional detail view of the fastening tool of FIG. 1, taken along line 7-7 of FIG. 6A.

Looking now at FIGS. 3A and 3B, to attach the magazine 50 to the fastening tool 10, the magazine is first positioned proximate the bottom portion 32 of the fastening tool so that alignment surfaces (not shown) on respective portions of the drive track 20 and the drive interface 55 are aligned, and so that the pivot member-engaging portion 55*a* is positioned proximate the pivot member 28. Then, as shown by the arrow in FIG. 3B, the magazine 50 is pivoted about the pivot member 28 toward the fastening tool bottom portion 32 so that respective magazine alignment surfaces 51 cooperate with fastening tool alignment surfaces 30 to maintain the magazine in alignment with the fastening tool 10, and so that certain of the fastening tool and magazine housing members 24, 56 are disposed adjacent to one another (FIG. 7). After the magazine 50 is fully engaged with the fastening tool 10, the respective alignment surfaces 30, 51 continue to maintain the alignment, as shown in the lower right-hand portions of FIGS. 11A and 11B. Then, as will be described below, an operator can releasably retain the magazine 50 in its properly-oriented position on the fastening tool 10 simply by rotating the cam 80 in a single plane against a force exerted by the biasing agent 100.

As shown in FIGS. 5A-5F, the cam or wedge 80 is a one-piece plastic unit having a lever 82 defining a ribbed portion 83, and further including a first lobe 84 and a second lobe 86. (If desired, the cam 80 may include just one lobe.) The first lobe 84 defines a cam profile 88 that includes an over-center stable region 89 adjacent a tipping point 91. The first lobe 84 also defines a female detent 90, that cooperates with a male detent 68 formed on the magazine 50 to releasably retain the cam 80 in an open or unlatched position (see FIGS. 11A and 11B). A cam pivot member 92 is rotatably disposed in the fastening tool housing 12 (see FIG. 7, and FIGS. 8A and 8B) about an axis 93, so that the cam lobes 84, 86 rotate in a single plane. The cam 80 cooperates with the biasing agent 100 to generate an over-center latch.

The biasing agent 100 is shown for example in FIGS. 9C, 11A, 11B, and 12A-12D, and includes two coil springs 102 disposed in respective spring chambers 103 defined by a pressure member 104. If desired, a single coil spring 102 of sufficient strength may be used instead. The pressure member 104 itself defines a pressure member cam profile 108 including an apex 110. As shown in FIGS. 9A-9C, the biasing agent 100 is disposed in a biasing agent chamber 66 defined by magazine housing members 56, such that the springs 102 normally bias the pressure member 104 in a direction outwardly of the biasing agent chamber. The operation of the magazine retention system 25 can now be described.

Figure 6A:
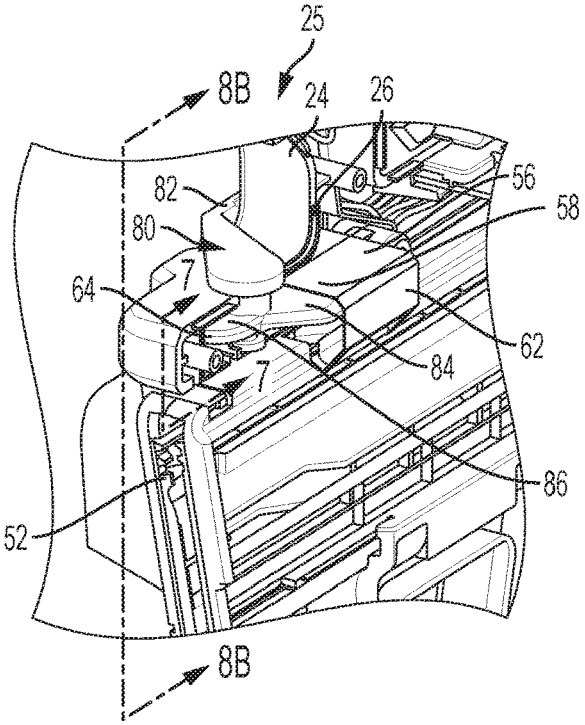
FIGS. 6A, 6B and 6C are partially cut-away perspective detail views of the magazine retention system of the fastening tool of FIG. 1, taken from the upper right rear of the fastening tool, and illustrating the relationship of the respective components as the cam is rotated from the closed to the open positions.
Figure 6B:
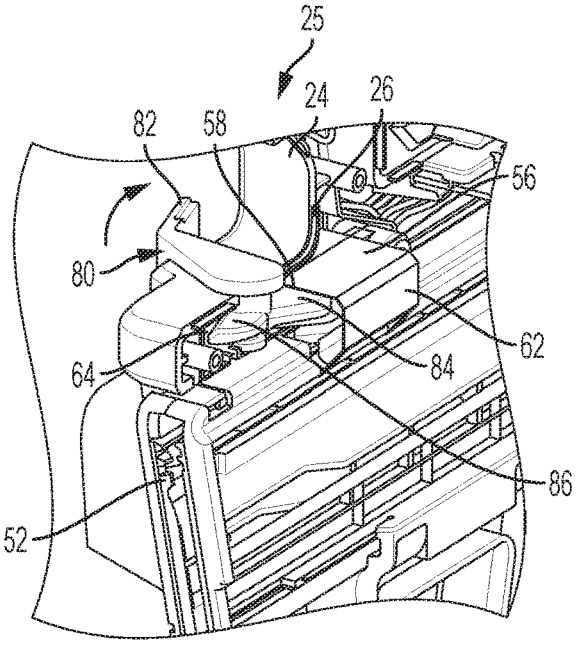
Figure 6C:
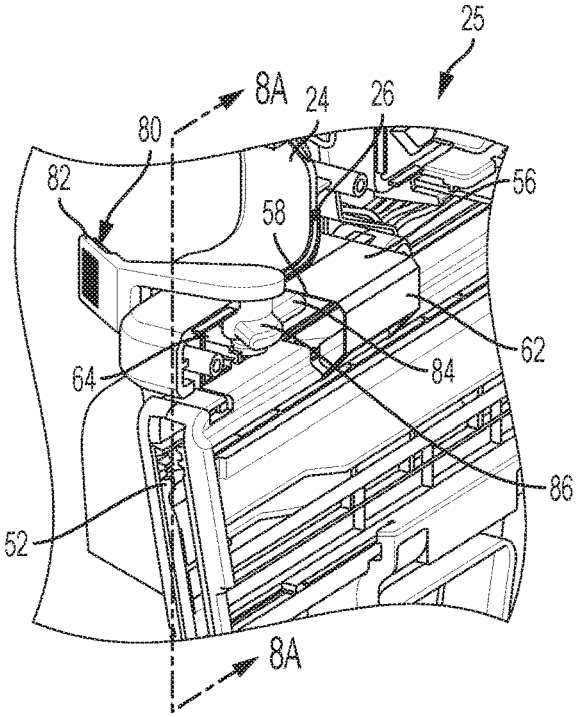
Figure 8B:
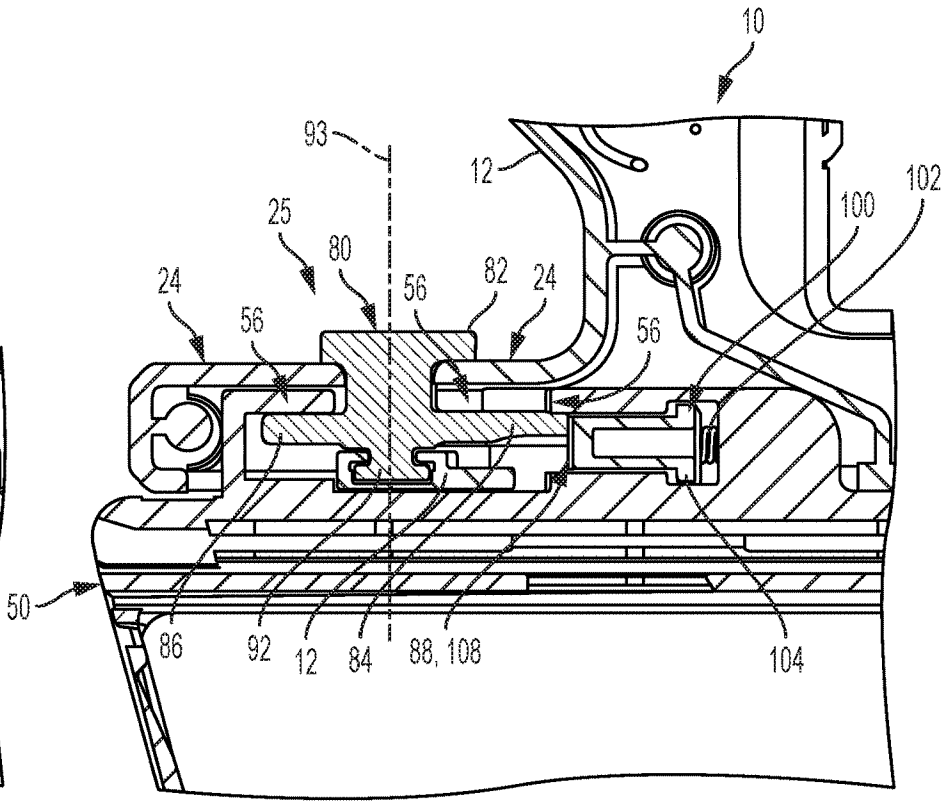
FIG. 8B is a partial elevational sectional view taken along line 8B-8B of FIG. 6A.
Figure 8A:
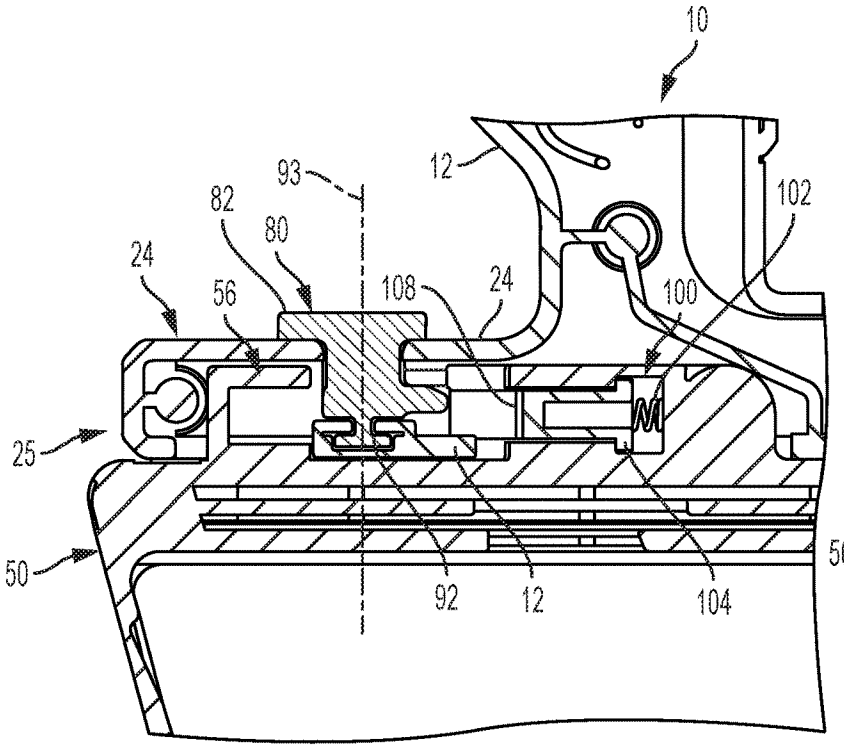
FIG. 8A is a partial elevational sectional view taken along line 8A-8A of FIG. 6C.
Figure 11A:
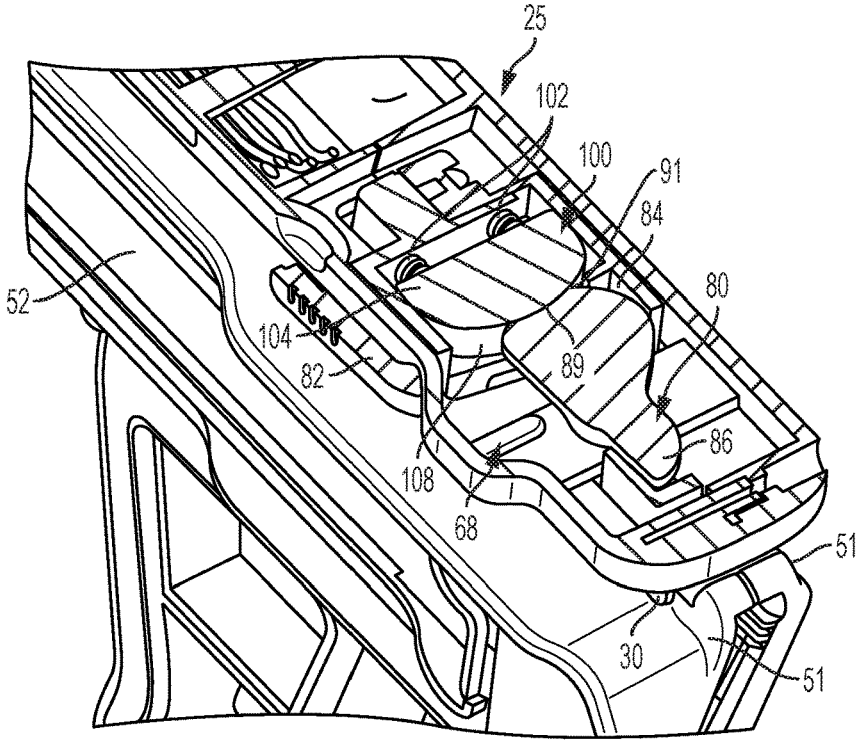
FIGS. 11A and 11B are partial perspective sectional views, with parts omitted for clarity, of the fastening tool and magazine of FIG. 1, showing the relative positions of the elements of the magazine retention system of the present invention in the latched and unlatched positions, respectively, and illustrating a detent used for maintaining the elements in the unlatched position.
Figure 11B:
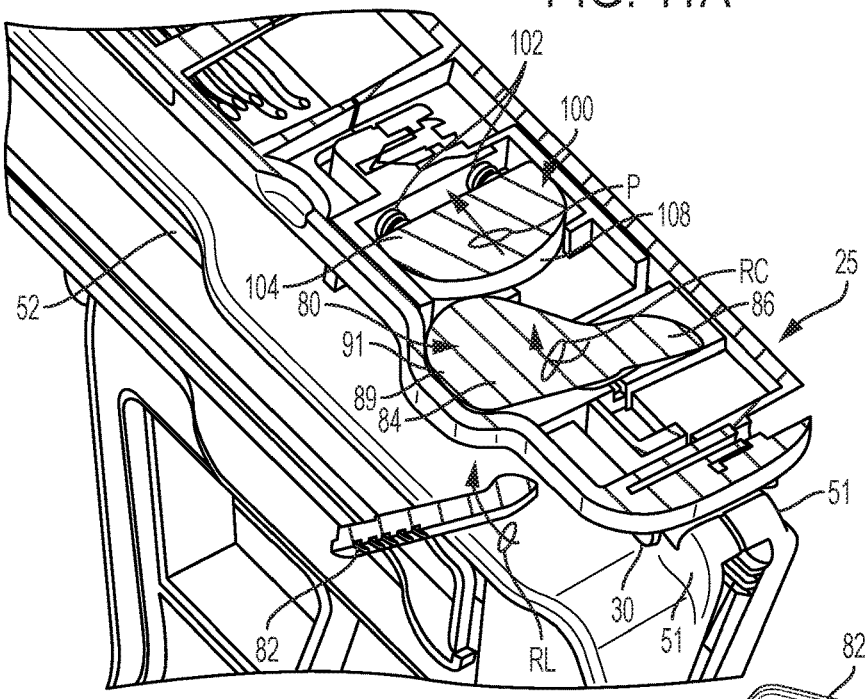
Figure 11C:
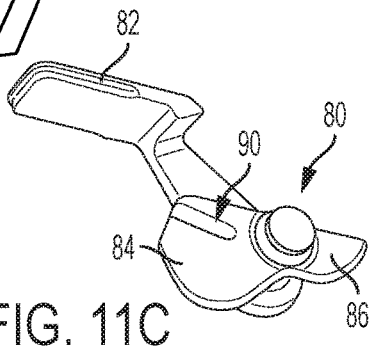
FIG. 11C is a perspective detail view of the cam of the present invention, showing in particular a detent that cooperates with the detent shown in FIG. 11A to maintain the elements in the unlatched position.
Figure 12C:
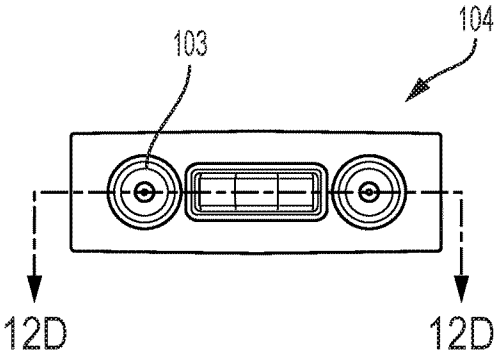
FIG. 12C is a front elevational view of the pressure member shown in FIG. 12A.
Figure 12B:
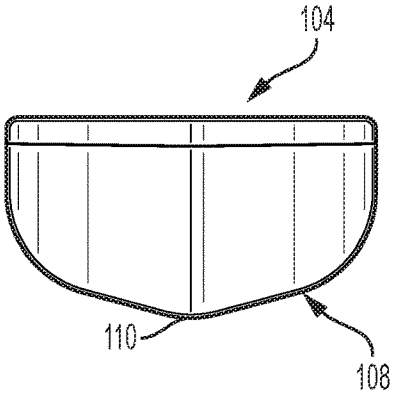
FIG. 12B is a top plan view of the pressure member of FIG. 12A.
Figure 12D:
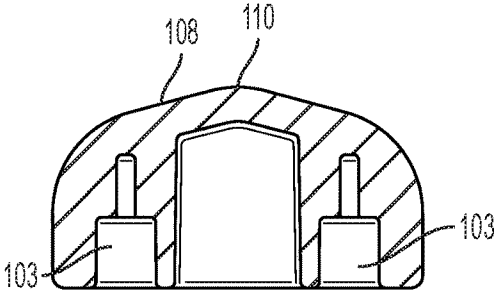
FIG. 12D is a sectional view taken along line 12D-12D of FIG. 12C.
Figure 12A:
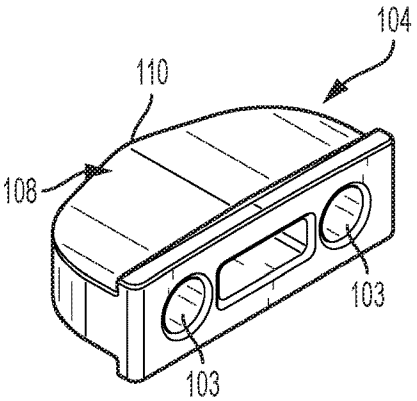
FIG. 12A is a perspective detail view of the pressure member of the magazine retention system of the fastening tool and magazine shown in FIG. 1.

A first element of a method according to the present invention of removably retaining the magazine 52 on the fastening tool 10 includes using the cam 80 to wedge a magazine housing member 56 against a fastening tool housing member 24, as shown by arrows W in FIG. 7, and as further illustrated in FIGS. 6A-6C, 8A, 8B, 11A and 11B. In the open or unlatched position, as shown in FIGS. 6C, 8A and 11B, the cam 80 has not yet engaged either a fastening tool housing member 24 or the pressure member 104 of the biasing agent 100. Then, as shown by the arrow in FIG. 6B, an operator begins to use the lever 82 to rotate the cam 80 clockwise (as viewed from the top), that thereby begins to rotate both the large and small lobes 84 and 86, respectively, out of their unlatched or open positions shown in FIG. 6C. As the cam 80 continues to rotate, the first lobe 84 of the cam will begin to engage the pressure member 104 so that respective cam profiles 88, 108 cooperate to start compressing coil springs 102, as shown by arrows RC and P in FIG. 11B. During this time, as shown in FIGS. 6B and 7, the first lobe 84 slides along a first wall 58 defined by a magazine housing member 56 and begins to wedge the first wall against a wall 26 defined by a fastening tool housing member 24. (Note that it is not the cam profile 88 that produces the wedging action.) The flat horizontal surface of the first cam lobe 84 slides across and wedges the magazine housing member first wall 58 against the fastening tool housing member wall 26. As such, the flat horizontal surface of first cam lobe 84 produces the wedging action. The wedging action is produced because, when the magazine 50 is attached to the fastening tool 10, cam 80 (and therefore lobes 84, 86) and walls 26, 58, are all oriented to be parallel to one another.

When the operator has moved the cam lever 82 to its closed or latched position shown in FIGS. 6A, 7 and 8B, the cam 80 now completely sandwiches the magazine first wall 58 between the first cam lobe 84 and the fastening tool wall 26. The magazine housing member 56 has now been wedged tightly against fastening tool housing member 24.

Figure 13:
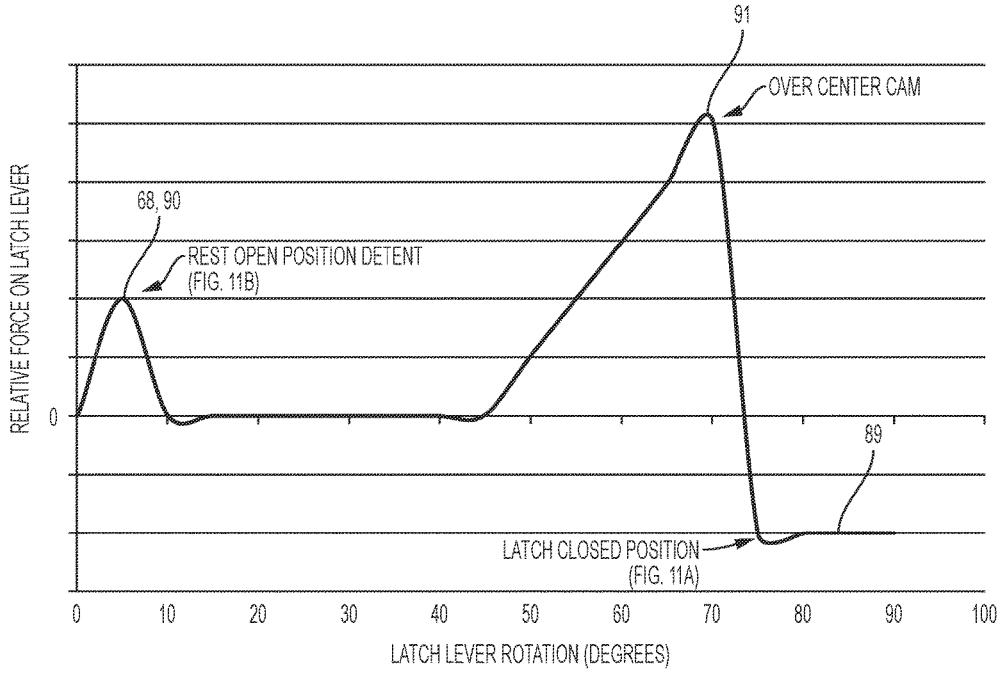
FIG. 13 is a force-rotation graph of the over-center latch of the present invention illustrating the relative force on the latch lever required to be overcome to rotate the latch lever from a rest (open) position through an over-center (closed) position.

The wedged elements 24, 56 and 80 are releasably retained in their latched or closed position by the operation of an over-center latch created by the cooperation of the cam 80 with the biasing agent 100. Referring once again to the cam profiles 88, 108 shown, respectively, in FIGS. 5A and 12B, the progress of the cam 80 in latching the magazine 50 to the fastening tool 10 is illustrated in the force-rotation chart of FIG. 13. Beginning at the open position shown in FIG. 11B, where the cam detent 90 cooperates with the magazine detent 68 to releasably retain the cam in the unlatched or open position, the chart shows that just a slight amount of force is required to move out of the detented position. This is followed by a short distance where no appreciable force need be exerted on the cam, by virtue of its configuration, until it has rotated a distance of approximately 45°. Then, as the cam profile 88 that is presented to the pressure member 104 changes, the force rapidly increases until the cam profile reaches its tipping point 91. If the operator continues to exert force on the cam lever 82, and as the cam 80 continues to encounter its wedging resistance against the first wall 58 of magazine housing member 56, the cam 80 will rapidly snap over the tipping point (the over-center action), that is illustrated by the steep decline of the curve of FIG. 13 from about 5 pounds of force to about −2 pounds of force. The cam 80 then reaches its steady-state closed or latched position where an over-center stable region 89 of the cam profile 88 is retained against a complementary region of the pressure member profile 108, as shown in FIG. 11A.

Figure 14A:
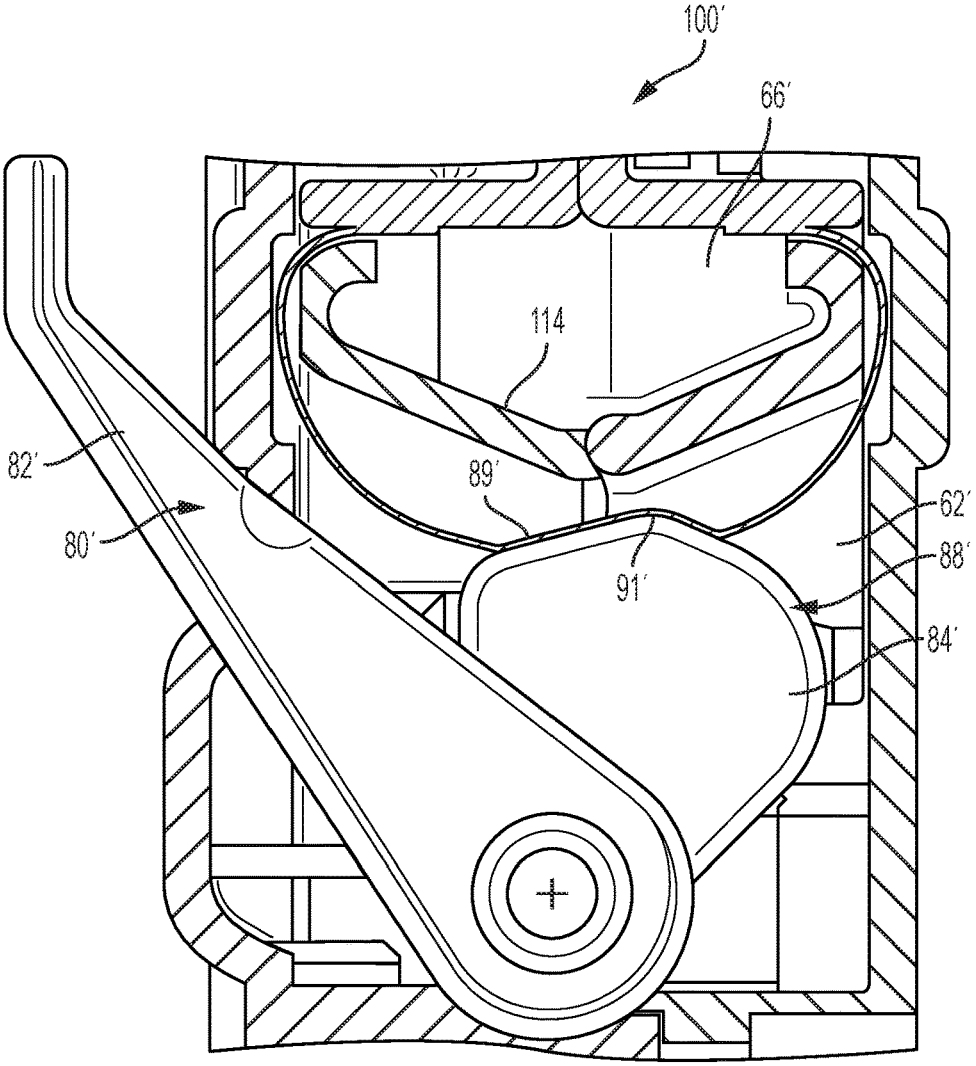
FIG. 14A is an enlarged detail view, partially in section, of another embodiment of a biasing agent of a magazine retention system of the fastening tool and magazine of FIG. 1.
Figure 14B:
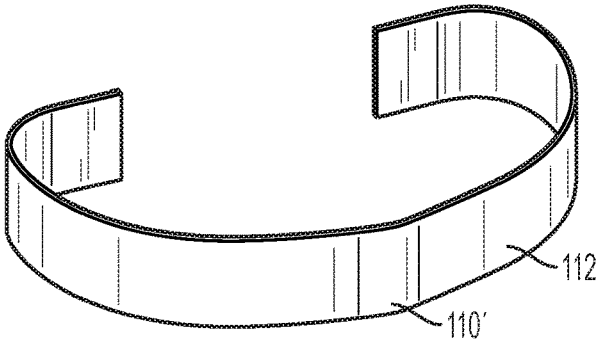
FIG. 14B is an enlarged perspective detail view of a sheet spring of the biasing agent of FIG. 14A.

In one embodiment of the magazine retention system 25, the springs 102 should be selected to exert a total of from 1 to 5 pounds of force (½ pound to 2½ pounds each) and preferably 3 pounds (1½ pounds each). Another embodiment of a cam 80' cooperating with a biasing agent 100' is shown in FIGS. 14A and 14B. Here the coil springs 102 have been replaced by a single sheet spring 112 defining an apex 110' and supported by a spring support 114. As shown in FIG. 14A, the sheet spring 112 deforms to conform to a cam stable region 89' and tipping point 91'. However, the sheet spring 112 should also be selected to exert a force ranging from 1 to 5 pounds, and preferably 3 pounds. All of the other elements of the fastening tool 10 and magazine 50 remain the same, such that, for example, a cam first lobe 84' defines a cam profile 88'.

Figure 15:
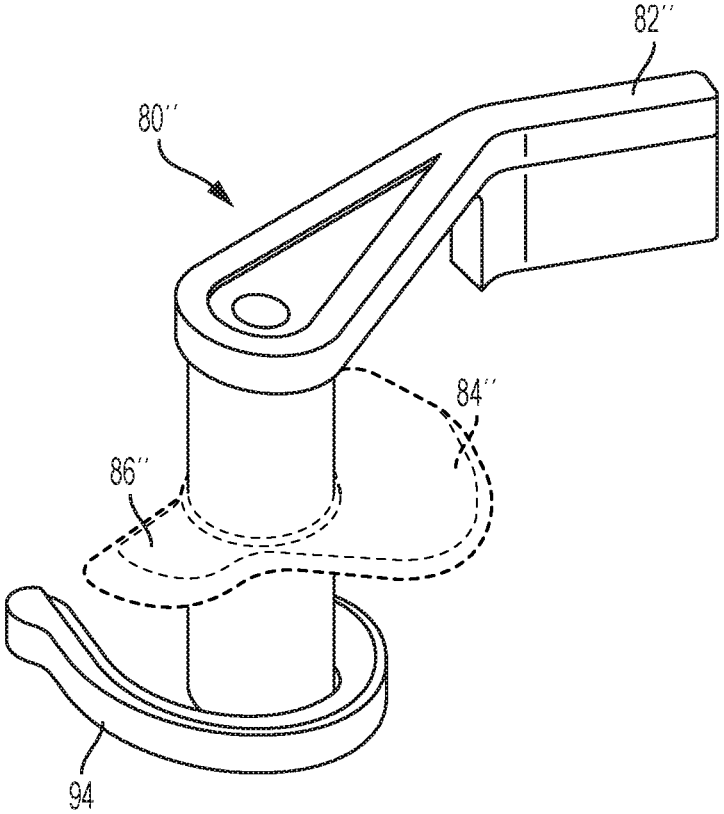
FIG. 15 is an enlarged perspective detail view of another embodiment of the cam of the present invention.

As shown in FIG. 15, still another embodiment of the present invention includes a one-piece cam 80" that again is made of plastic and that defines a lever 82" and first and second cam lobes 84", 86" (shown in phantom for clarity). However, this embodiment of the one-piece cam 80" also includes a built-in flexible biasing agent 94 that should be selected to exert the same ranges of forces as previously noted with respect to the other embodiments of the biasing agents 100, 100' described above.

In the first embodiment of the fastening tool 10 and magazine 50 of the present invention shown in FIGS. 1-15, the cam 80 is shown rotatably mounted on the fastening tool housing 12; and the biasing agent 100, together with the various chambers to be discussed shortly, are disposed on the magazine. However, if desired, the locations of these elements may be reversed, as shown schematically in FIGS. 16A and 16B that illustrate another embodiment of a fastening tool 200 and a magazine 250 of the present invention. Here a cam 280 is disposed on a magazine housing 252 instead of the fastening tool housing 12, and a biasing agent 290 and various chambers are disposed on the fastening tool 200; this embodiment will be discussed at greater length shortly.

As shown in FIG. 7, a first element in a method according to an embodiment of the present invention of removably retaining the fastener magazine 50 on the fastening tool 10 includes the act of wedging together respective proximately-disposed magazine and fastening tool housing members 56, 24, described above. If desired, a second element in this method may include, simultaneously with rotating the cam 80 against the magazine housing member 56, rotating cam lobes 84, 86 into respective chambers created by magazine housing members 56. This creates a secondary retention system that is effective to assist in retaining the magazine 50 on the fastening tool 10, for example, if the fastening tool is dropped.

Referring now to FIGS. 2, 6A-6C, 7, 8A and 8B, 9A-9C, 10 and 11A-11C, the magazine 50 of an embodiment of the present invention may, if desired, include first and second chambers 62, 64, and a biasing agent chamber 66. Also if desired, a single chamber can be provided to accommodate cams 80 having just a single lobe. Furthermore, the first chamber 62 and the biasing agent chamber 66 may be defined by respective magazine housing members 56, and the second chamber 64 may also be defined at least in part by a magazine housing second wall 60 (FIG. 7). This second element of the method according to the present invention of removably retaining the magazine 50 on the fastening tool 10 is illustrated, for example, in FIGS. 6A-6C.

As an operator begins to rotate the cam lever 82 clockwise from the open or unlatched position shown in FIG. 6C, the first and second cam lobes 84, 86 also necessarily begin simultaneously to rotate (FIG. 6B). Finally, when the operator has completely rotated the cam lever 82 to its closed or latched position shown in FIG. 6A, the first and second cam lobes 84, 86 have entered corresponding first and second chambers 62, 64, respectively. Various elements of the chambers 62, 64 now cooperate with the first and second cam lobes 84, 86 to assist in retaining the magazine 50 on the fastening tool 10, for example, in the event the fastening tool is dropped. For purposes of illustration, the magazine 50 is shown in FIG. 10 juxtaposed with the fastening tool 10, so that cam lobes 84, 86 are positioned over their respective chambers 62 and 64, as shown by the dotted lines.

Figure 16A:
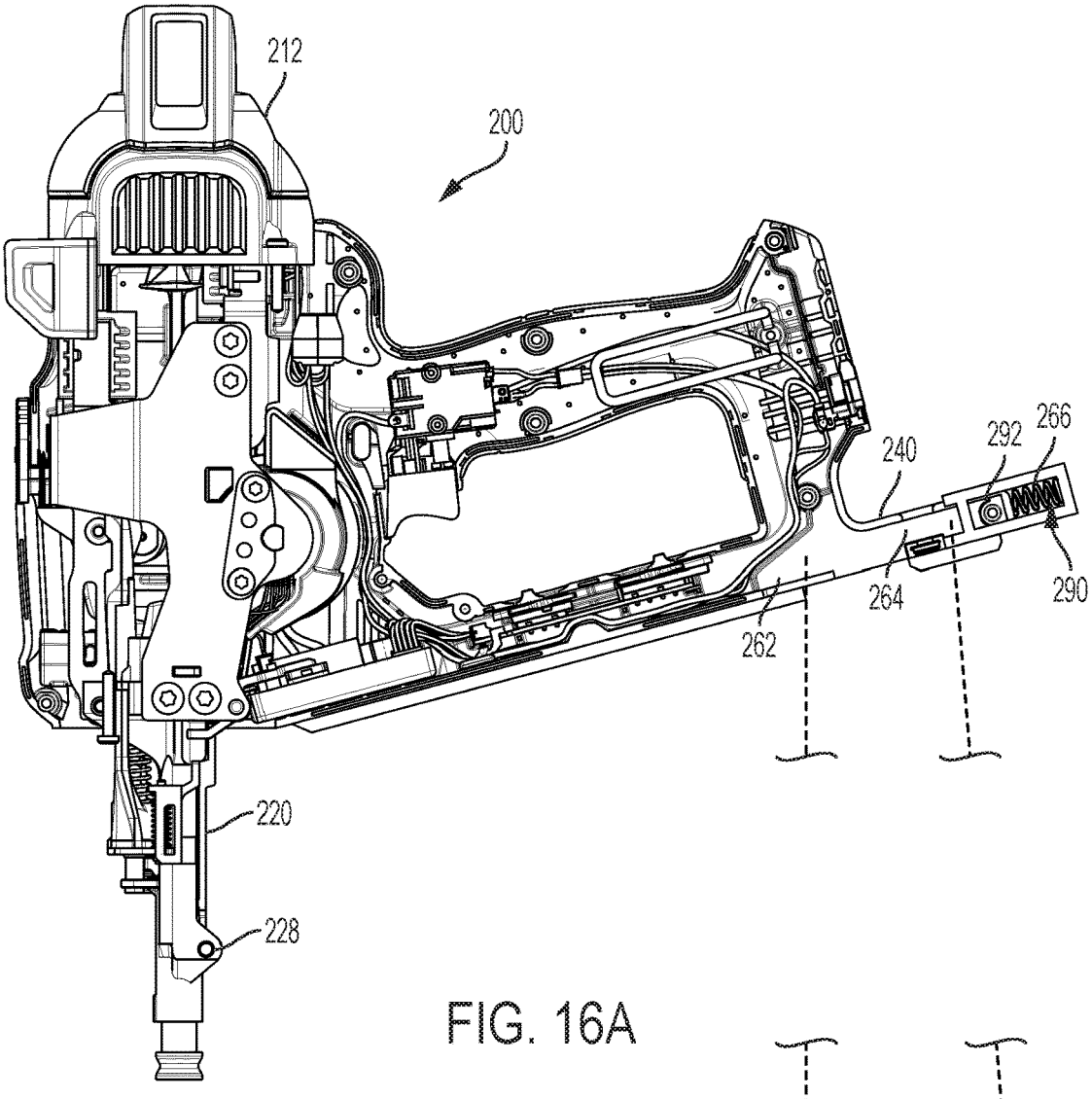
FIG. 16A is a schematic elevational detail view, with one housing half removed for clarity, of another embodiment of the fastening tool of the present invention.
Figure 16B:
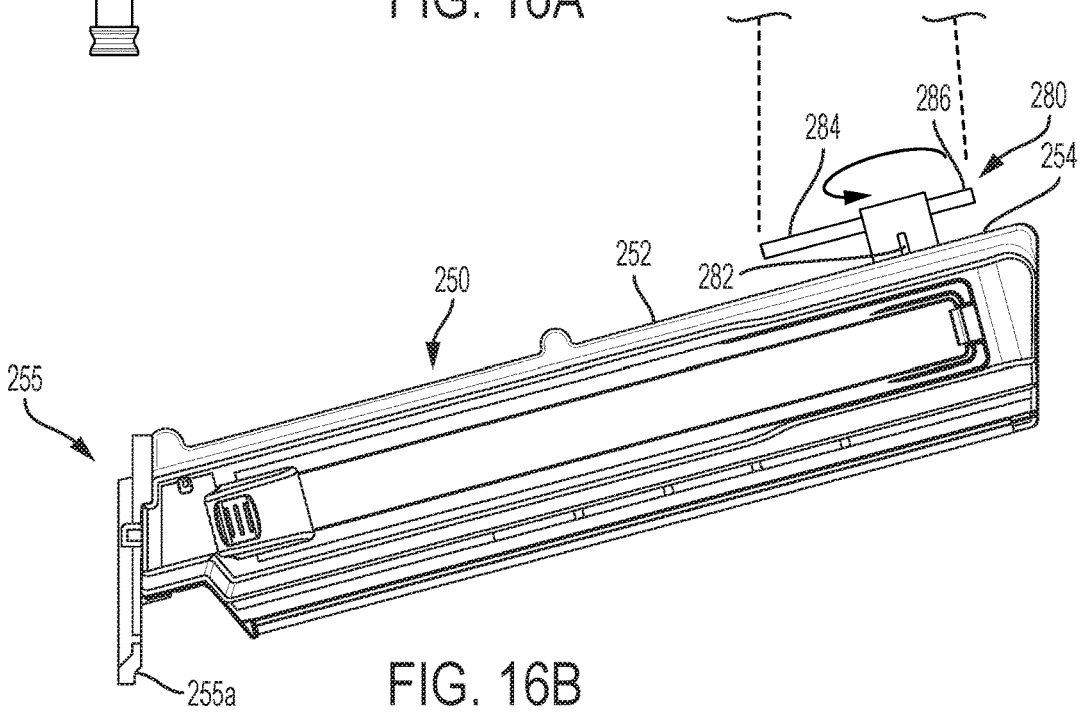
FIG. 16B is a schematic elevational detail view of a magazine for use with the fastening tool of FIG. 16A.

Returning to the embodiment of the fastening tool 200 and magazine 250 shown in FIGS. 16A and 16B, the fastening tool includes a housing 212, a drive track 220, and a pivot member 228. The fastening tool housing 212 also includes a plurality of fastening tool housing members 240 that in turn define first and second chambers 262, 264, as well as a biasing agent chamber 266. In this embodiment of the magazine 250, a drive interface 255 defines a pivot member-engaging portion 255*a*, that cooperates with pivot member 228, as was described in reference to the first embodiment of the fastening tool 10 and magazine 50. The magazine 250 also includes a magazine housing 252 that defines a plurality of magazine housing members 254. A wedge or cam 280 is rotatably mounted on the magazine housing 252 and is operated by a lever 282. The cam 280 includes first and second lobes 284, 286 which, after the magazine 250 has been connected to the fastening tool 200, may be rotated into respective chambers 262, 264, as shown by the dotted lines, as the cam 280 is rotated against the force of a biasing agent 290 acting on a pressure member 292. During this rotation, the cam 280 wedges together the respective tool and magazine housing members 240, 254 in a fashion similar to that described earlier with respect to the first embodiment of the fastening tool 10 and magazine 50.

Figure 17A:
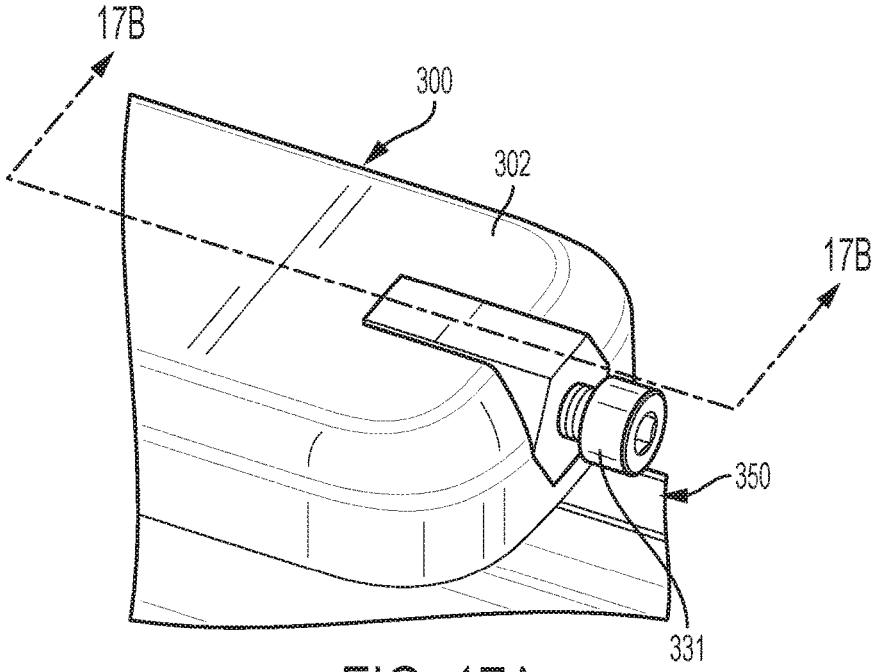
FIG. 17A is a partial perspective detail view of a fastening tool according to yet another embodiment of the present invention.
Figure 17B:
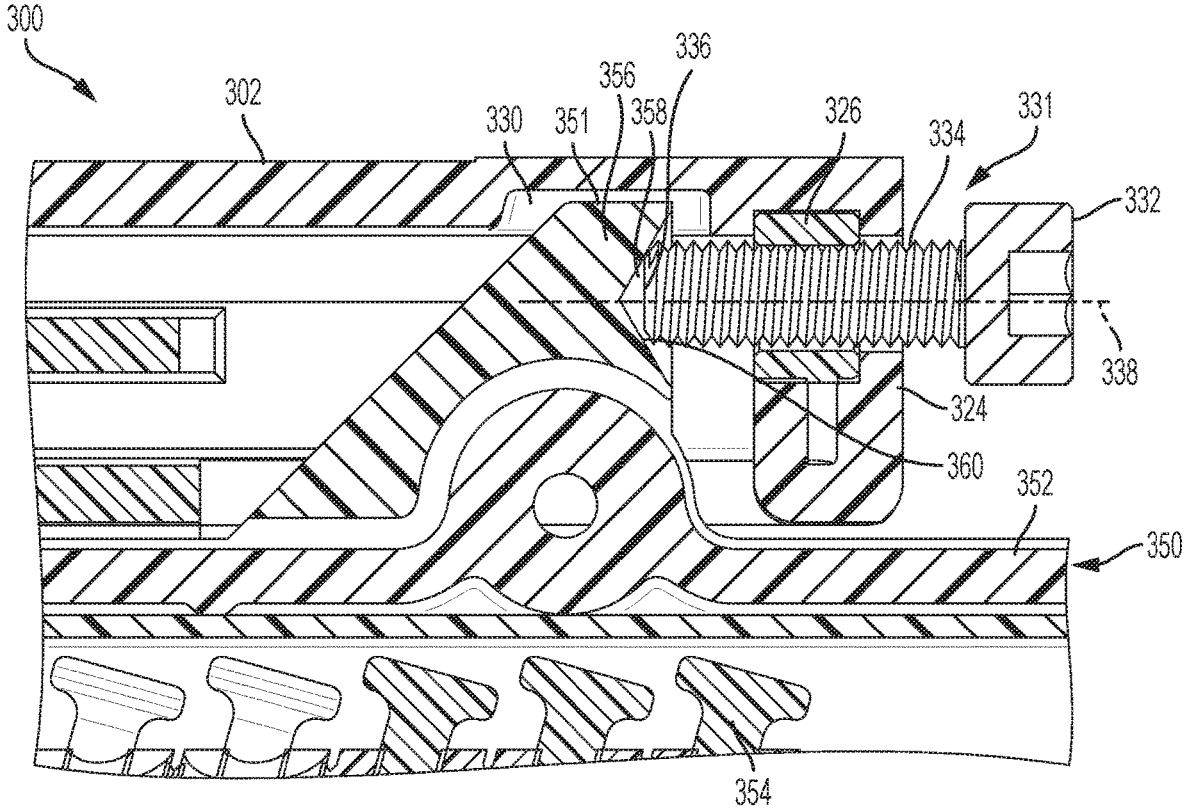
FIG. 17B is an elevational sectional detail view taken along line 17B-17B of FIG. 17A.

Referring now to FIGS. 17A and 17B, a third embodiment of the fastening tool 300 and magazine 350 of the present invention provides a simplified method for retaining the magazine on the fastening tool. Outside of the regions depicted in FIGS. 17A and 17B, all of the other elements of the fastening tool 300 and magazine 350 are the same as those described earlier with respect to the fastening tool 10 and magazine 50 of the present invention. In this embodiment, the fastening tool 300 includes a housing 302 that in turn defines a plurality of fastening tool housing members 324. The fastening tool 300 further includes a floating nut 326 threadedly engaged with a bolt 331 and disposed in a fastening tool housing member 324. The bolt 331 includes a head 332, threads 334 and a tip 336, all of which lie along an axis 338.

Magazine 350 includes magazine alignment surfaces 351 that cooperate with the fastening tool housing 302 and alignment surfaces 330 to retain the magazine properly oriented with the fastening tool 300. The magazine 350 also includes a magazine housing 352, a plurality of nails 354, and magazine housing members 356. One such magazine housing member 356 may include a bolt receptacle 358 defining a conical inner surface 360.

To retain the magazine 350 on the fastening tool 300, the magazine is first placed into alignment with the fastening tool, as was previously described, so that the bolt receptacle 358, bolt tip 336, and bolt head 332 are axially aligned along axis 338. Then the bolt 331 is threaded into engagement with the bolt receptacle 358, and is tightened in the floating nut 326. The geometry of the conical surface 360 of the bolt receptacle 358 cooperates with the tip 336 of the bolt 331 to compensate for variations in tolerances in the bolt receptacle, bolt, magazine 350 and fastening tool 300 as the bolt is tightened in the floating nut 326. For example, if the bolt 331 is slightly off-center with axis 338, the receptacle conical surface 360 ensures that the bolt nevertheless makes firm contact with the receptacle 358. It should be noted that, if desired, the locations of the respective retention components on the fastening tool 300 and magazine 350 may be reversed, for example, by mounting the bolt 331 and nut 332 on the magazine 350, and the bolt receptacle 358 on the fastening tool 300.

It can now be seen that two embodiments of the magazine 50, 250 of the present invention can be removably but securely retained on the fastening tool 10, 200 of the present invention by rotating a one-piece wedge or cam 80, 280, using a single motion in a single plane, as part of an over-center latch. Thus, the magazine retention system 25 of the present invention according to such two embodiments requires absolutely no tools, and provides a simple yet elegant solution to the problems previously embodied in conventional fastening tools.

While the present invention has been described with respect to various embodiments of a concrete nailer, the present invention may be further modified within the spirit and scope of this disclosure to apply to other products as well. This application is therefore intended to cover any variations, uses, or adaptations of the present invention using its general principles. Further, this application is intended to cover such departures from the present disclosure as come within known or customary practice in the art to which this invention pertains and which fall within the limitations of the appended claims.

What is claimed is:

1. A fastening tool, comprising:

a fastening tool housing including a fastening tool housing member having a first surface;

a drive system disposed in the fastening tool housing at one end thereof and defining a drive track for guiding a fastener along a drive axis;

a magazine connected to the fastening tool housing, the magazine having a magazine housing including a magazine housing member having a first surface, the magazine further having a drive interface, the drive interface being configured to present fasteners to the drive track;

a cam having at least one portion disposed in the fastening tool housing member, the cam being rotatable along a plane passing through the fastening tool housing member and rotatably engageable with one of the first surface of the fastening tool housing member and the first surface of the magazine housing member to sandwich said one of the housing members between the cam and the other of the fastening tool housing member and magazine housing member to releasably maintain the magazine fully connected to the fastening tool housing; and a biasing agent configured to bias the cam upon rotation of the cam from an unlatched position to a latched position, wherein the biasing agent has a compressed state and an uncompressed state and is configured to bias the cam in the latched position when in the compressed state and return to the uncompressed state upon rotation of the cam to the unlatched position, wherein the magazine is at least partially removable from the fastening tool housing, and wherein the fastening tool housing member is disposed proximate the magazine housing member when the magazine is fully connected to the fastening tool housing.

2. The fastening tool claimed in claim 1, wherein the drive interface defines a pivot member-engaging portion that provides a primary retention system for maintaining the magazine fully connected to the fastening tool.

3. The fastening tool claimed in claim 1, wherein the fastening tool and magazine housing members are parallel to each other, and wherein the cam is rotatably connected to one of the magazine housing and the fastening tool housing, and wherein the cam is configured to releasably engage the housing member of the other of the magazine housing and the fastening tool housing.

4. The fastening tool claimed in claim 3, wherein the biasing agent and the cam are configured to cooperate to maintain the cam engaged with the other of the magazine and fastening tool housing member by an over-center latch.

5. The fastening tool claimed in claim 3, wherein the cam includes a lobe and a lever, wherein one of the magazine housing and the fastening tool housing defines a chamber configured to accept the lobe, such that when the lever moves the cam to the latched position, the lobe engages the other of the magazine and fastener tool housing member and simultaneously enters the chamber, thereby providing a secondary retention of the magazine on the fastening tool housing.

6. The fastening tool claimed in claim 3, wherein the cam defines first and second lobes and a lever, and is movable from an unlatched position to a latched position, and wherein one of the magazine housing and the fastening tool housing define first and second chambers configured to accept the first and second lobes, respectively; such that when the lever moves the cam to the latched position, the first lobe engages the other of the magazine and fastening tool housing member, and the first and second lobes simultaneously enter the first and second chambers, respectively.

7. The fastening tool claimed in claim 3, wherein the biasing agent includes a pressure member normally biased by at least one coil spring in a direction to engage the cam, and wherein the at least one coil spring and the pressure member are disposed on the other of the magazine housing and the fastening tool housing.

8. The fastening tool claimed in claim 6, wherein the biasing agent includes a sheet spring configured to be normally biased into engagement with the cam, and wherein when the lever moves the cam from the unlatched to the latched position, the first lobe deforms the sheet spring, and wherein the first lobe engages the sheet spring to produce an over-center latch.

9. The fastening tool claimed in claim 3, wherein the cam and one of the magazine housing and the fastening tool housing define respective engaging detents to releasably retain the cam in an unlatched position.

10. The fastening tool claimed in claim 1, wherein the wedge includes a cam rotatably connected to one of the magazine housing and the fastening tool housing, and wherein the cam includes a resilient portion configured to bias the cam in a position to maintain the cam in engagement with the other of the magazine housing and the fastening tool housing.

11. The fastening tool claimed in claim 1, wherein the drive interface forms a portion of the drive track.

12. The fastening tool claimed in claim 2, wherein the cam includes a portion operatively associated with a chamber defined by one of the fastening tool and magazine housing to provide a secondary retention system for maintaining the magazine fully connected to the fastening tool housing.

13. The fastening tool claimed in claim 1, wherein the drive interface is located at a proximal end of the magazine and the magazine housing member is located at a distal end of the magazine, and wherein the cam is rotatably engageable with one of the first surface of the fastening tool housing member and the first surface of the magazine housing member at the distal end of the magazine.

14. A method of removably retaining a magazine on the fastening tool of claim 1, comprising:

moving a movable member into releasable engagement with one of a magazine housing member of a magazine housing and a fastening tool housing member of a fastening tool housing; and wedging the magazine housing member and the fastening tool housing member together.

15. The method claimed in claim 14, further comprising:

prior to the wedging step, pivoting the magazine about a pivot disposed on the fastening tool so that the magazine housing member is disposed adjacent the fastening tool housing member.

16. The method claimed in claim 14, wherein the steps of moving and wedging are accomplished without tools.

17. The method claimed in claim 14, further comprising:

maintaining the magazine housing member in a wedged condition against the fastening tool housing member by biasing the respective housing members in the wedged condition.

18. The method claimed in claim 14, further comprising:

simultaneously moving a portion of the movable member into a chamber defined by one of the fastening tool and magazine housings to assist in retaining the magazine on the fastening tool.

19. The method claimed in claim 17, further comprising:

rotating the movable member against one of the magazine housing member and the fastening tool housing member to wedge one of the magazine housing member and the fastening tool housing member between the movable member and the other of the magazine housing member and the fastening tool housing member.

20. The method claimed in claim 14, wherein the magazine and fastening tool housing members are substantially parallel, and wherein the movable member rotates in a plane substantially parallel to the magazine and fastening tool housing members.

21. The method claimed in claim 14, further comprising:

providing a cam on the movable member; and rotating the cam against the force of a biasing agent to produce a releasable over-center latch of the cam against one of the housing members.

22. The method claimed in claim 21, further comprising:

providing a first lobe and a second lobe on the cam; and rotating the cam from an unlatched position to a latched position so that the first lobe wedges the housing members together, while the first and second lobes simultaneously enter respective first and second chambers defined by one of the fastening tool housing and the magazine housing.

23. The method claimed in claim 22, wherein the cam and the biasing agent are mounted on one of the fastening tool housing and the magazine housing, and wherein the first and second chambers are formed by the other of the fastening tool housing and the magazine housing.

24. The method claimed in claim 22, further comprising:

releasably maintaining the cam in the open position by engaging a detent formed on one of the first and second lobes with a detent formed on one of the magazine housing and the fastening tool housing.

25. The method claimed in claim 21, further comprising:

providing a lobe on the cam;

rotating the lobe of the cam into a chamber, a wall of which is defined by one of the fastening tool and magazine housings; and simultaneously wedging the cam against one of the other of the fastening tool and magazine housings, thereby creating a secondary retention system.

26. The method claimed in claim 25, wherein the lobe engages one of the housings.

* * * * *